US008457514B2

(12) United States Patent
Mizumo

(10) Patent No.: US 8,457,514 B2
(45) Date of Patent: Jun. 4, 2013

(54) CYLINDRICAL HEATING ELEMENT AND FIXING DEVICE

(75) Inventor: Yoshiyuki Mizumo, Kaizuka (JP)

(73) Assignee: Konica Minolta Business Technologies, Inc, Chiyoda-ku, Tokyo (JP)

( * ) Notice: Subject to any disclaimer, the term of this patent is extended or adjusted under 35 U.S.C. 154(b) by 360 days.

(21) Appl. No.: 12/882,629

(22) Filed: Sep. 15, 2010

(65) Prior Publication Data

US 2011/0069985 A1 Mar. 24, 2011

(30) Foreign Application Priority Data

Sep. 18, 2009 (JP) ..... 2009-216713

(51) Int. Cl.
*G03G 15/20* (2006.01)

(52) U.S. Cl.
USPC ..... 399/69; 219/216; 399/328

(58) Field of Classification Search
USPC ..... 399/69, 333, 328; 219/216, 469–471, 219/552, 538
See application file for complete search history.

(56) References Cited

U.S. PATENT DOCUMENTS

| | | | | | |
|---|---|---|---|---|---|
| 4,304,985 | A | * | 12/1981 | Miller | 219/216 |
| 4,315,136 | A | * | 2/1982 | Block et al. | 219/216 |
| 4,628,183 | A | * | 12/1986 | Satomura | 219/216 |
| 4,778,980 | A | | 10/1988 | Rathbun | |
| 4,796,046 | A | | 1/1989 | Suzuki et al. | |
| 4,813,372 | A | | 3/1989 | Kogure et al. | |
| 5,402,211 | A | | 3/1995 | Yoshikawa | |
| 5,575,942 | A | * | 11/1996 | Watanabe | 219/469 |
| 5,729,814 | A | | 3/1998 | Suzuki et al. | |
| 5,822,670 | A | | 10/1998 | Morigami | |
| 5,826,152 | A | | 10/1998 | Suzuki et al. | |
| 5,994,671 | A | * | 11/1999 | Suzuki et al. | 219/216 |
| 6,522,846 | B2 | * | 2/2003 | Kinouchi et al. | 219/216 |
| 6,643,491 | B2 | | 11/2003 | Kinouchi et al. | |
| 6,734,397 | B2 | * | 5/2004 | Kato et al. | 219/216 |

(Continued)

FOREIGN PATENT DOCUMENTS

| | | |
|---|---|---|
| CN | 1495572 | 5/2004 |
| JP | 60-087376 | 5/1985 |

(Continued)

OTHER PUBLICATIONS

Office Action issued in corresponding Chinese Patent Application No. 201010288314.8, issued Aug. 23, 2012, and English translation thereof.

(Continued)

*Primary Examiner* — Susan Lee
(74) *Attorney, Agent, or Firm* — Buchanan Ingersoll & Rooney PC

(57) ABSTRACT

A cylindrical heating element comprising a cylindrical member, a metallic pattern provided on at least one of outer and inner circumferential surfaces of the cylindrical member, which is capable of generating heat by being electrified, and a resistive pattern for detecting temperature provided on at least one of the outer and inner circumferential surfaces of the cylindrical member. A fixing device which passes a recording medium on which an unfixed toner image is held through a nip formed by a rotating member for heating and a rotating member for pressurizing which is pressed against the rotating member for heating to fix the toner image on the recording medium with heating under pressure, the rotating member for heating comprising the cylindrical heating element.

8 Claims, 11 Drawing Sheets

U.S. PATENT DOCUMENTS

| | | | | |
|---|---|---|---|---|
| 6,788,906 | B2 * | 9/2004 | Suzuki et al. | 399/69 |
| 7,026,578 | B2 * | 4/2006 | Mori et al. | 219/216 |
| 7,292,801 | B2 * | 11/2007 | Yoshikawa | 399/69 |
| 7,999,211 | B2 * | 8/2011 | Ruiz et al. | 219/216 |
| 2005/0129400 | A1 | 6/2005 | Kim et al. | |
| 2005/0129434 | A1 * | 6/2005 | Kim | |
| 2007/0068932 | A1 * | 3/2007 | Hewes et al. | 219/552 |
| 2009/0202200 | A1 | 8/2009 | Holmstrom et al. | |
| 2009/0202266 | A1 * | 8/2009 | Kurata et al. | |
| 2009/0220288 | A1 | 9/2009 | Omata | |

FOREIGN PATENT DOCUMENTS

| | | | |
|---|---|---|---|
| JP | 61-148477 | | 7/1986 |
| JP | 5-158369 | A | 6/1993 |
| JP | 5-210336 | A | 8/1993 |
| JP | 07-271239 | | 10/1995 |
| JP | 2005-258100 | | 9/2005 |
| JP | 2005258143 | A * | 9/2005 |
| JP | 2007-148127 | | 6/2007 |
| JP | 2008-268354 | | 11/2008 |

OTHER PUBLICATIONS

Office Action issued in Chinese Patent Application No. 201010288382.4, issued Aug. 23, 2012, and English translation thereof.

Office Action issued in Chinese Patent Application No. 201010288363.1, issued Aug. 23, 2012, and English translation thereof.

* cited by examiner

Flg.5
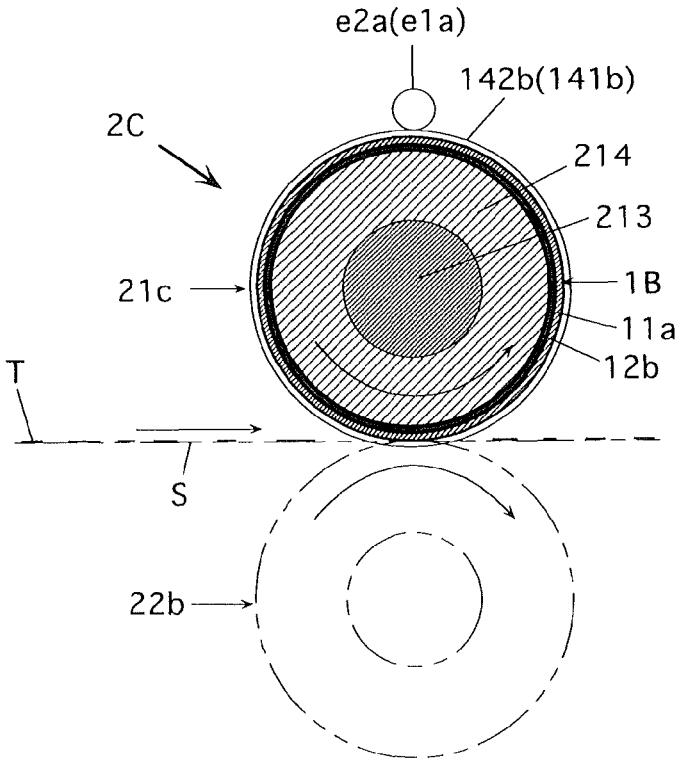
Flg.6
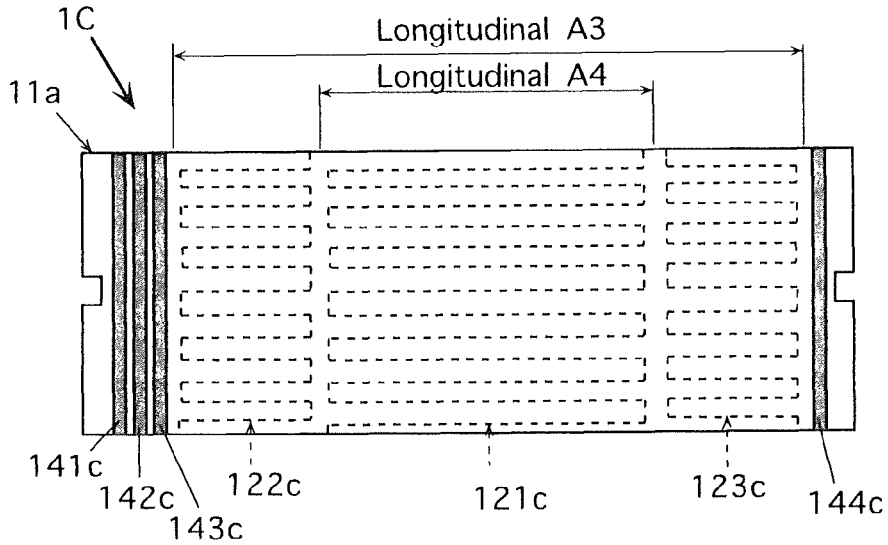

Fig,12(A)
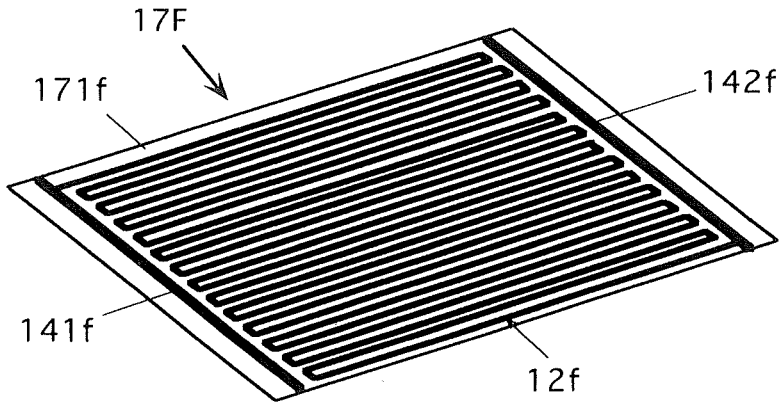
Fig,12(B)
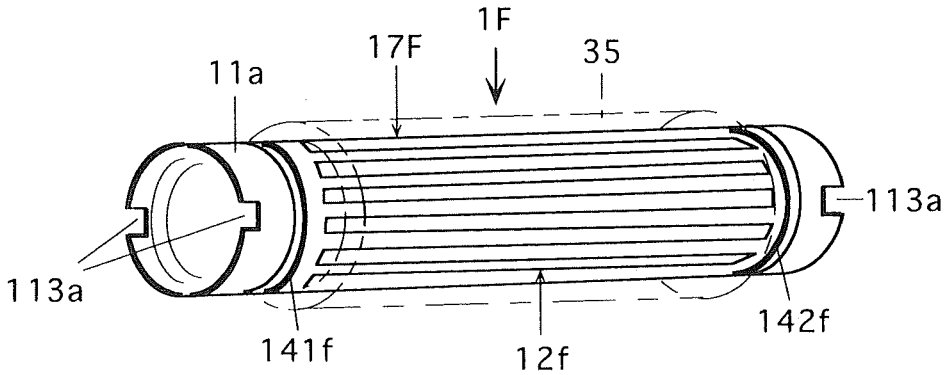
Fig,12(C)
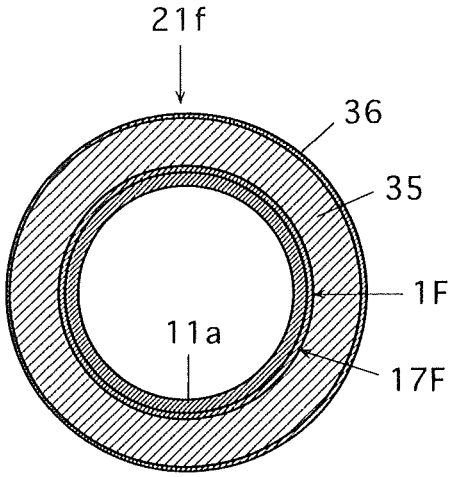

Flg.17
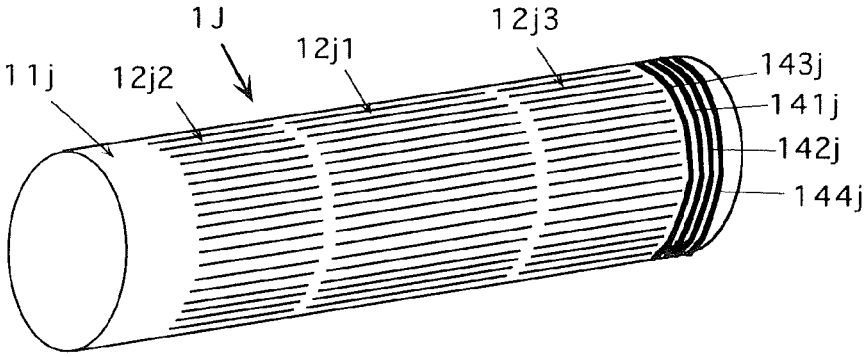
Flg.18
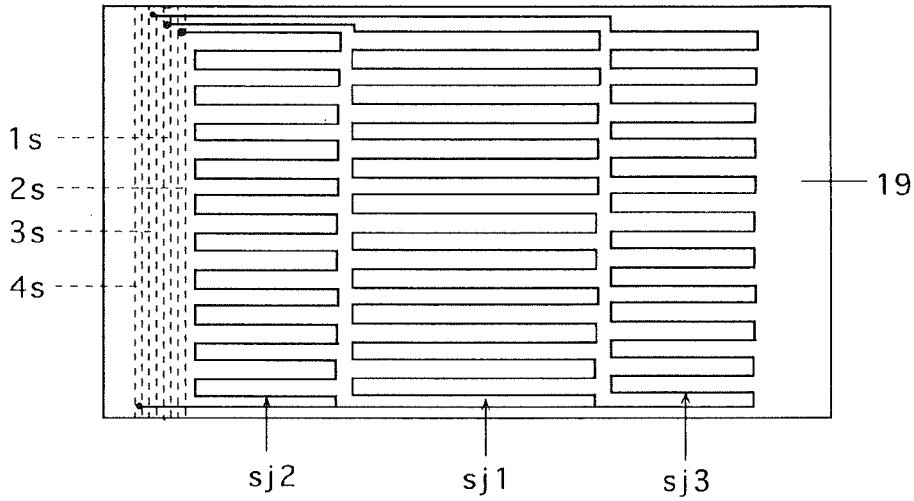
Flg.19
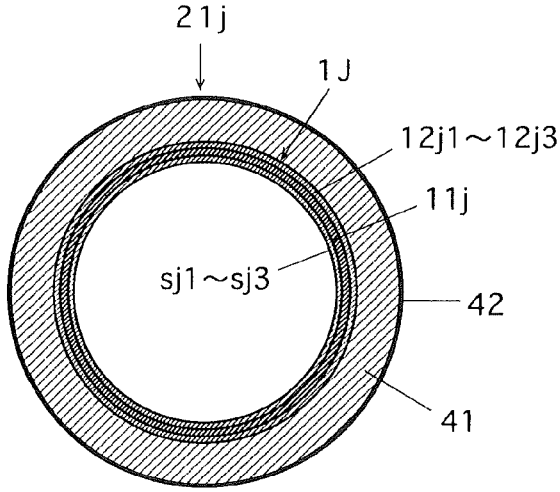

CYLINDRICAL HEATING ELEMENT AND FIXING DEVICE

CROSS-REFERENCE TO RELATED APPLICATION

This invention is based on Japanese patent application No. 2009-216713 filed in Japan on Sep. 18, 2009, the entire content of which is hereby incorporated by reference.

BACKGROUND OF THE INVENTION

1. Field of the Invention

The present invention relates to a heating element which can be used as a rotating member for heating or a part thereof in a fixing device employed in an image forming device operated by an electrophotographic system, electrostatic recording system and other systems, that is, a fixing device which fixes, on a recording medium such as a recording paper sheet, a toner image formed in an image forming portion of the image forming device and transferred onto the recording medium by passing the recording medium (on which an unfixed toner image is held) through a nip formed by the rotating member for heating and a rotating member for pressurizing which is pressed against the rotating member for heating with heating under pressure, and further to a fixing device using such a cylindrical heating element.

2. Description of Related Art

Fixing devices employed in image forming devices operated by the electrophotographic system, electrostatic recording system or like system generally comprise a rotating member for heating 91 and a rotating member for pressurizing 92 which is pressed against the rotating member for heating 91, as shown in FIG. 22 as an example.

The rotating member for heating 91 is usually constituted by providing an elastic material layer 912 made of elastic material such as a silicon rubber around a hollow metal shaft 911 and disposing a heater H such as a halogen lamp heater inside the metal shaft 911. The elastic material layer 912 is covered with a fluorine-based wear-resistant film 913 in some cases.

The rotating member for pressurizing 92 is formed by providing an elastic material layer 922 around a shaft 921. The elastic material layer 922 is covered with a fluorine-based wear-resistant film 923 in some cases.

This type of fixing device is described in Japanese Unexamined Patent Publication Nos. H05-158369 (JP05-158369,A) and H05-210336 (JP05-210336,A).

However, in the above-mentioned conventional fixing device, the hollow metal shaft 911 having the heater H incorporated therein for the rotating member for heating 91 has large heat capacity because it is thickly formed so that it has sufficient strength as the shaft for the rotating member and for other reasons. Therefore, according to the heat-source portion comprising the hollow metal shaft 911 having the heater H incorporated therein, it takes much time to heat the surface of the rotating member for heating 91 to a temperature at which the toner image is fused with heating and is fixed onto the recording medium (a so-called warm-up time is long), and therefore it has been difficult to meet the demand for shortening the warm-up time of fixing devices for the ease of use of the devices and thus of image forming devices, and the recent demand for energy saving.

SUMMARY OF THE INVENTION

A first object of the present invention is to provide a heating element which can be utilized as a heat source for a rotating member for heating in a fixing device which is employed in an image forming device operated by an electrophotographic system, electrostatic recording system or like system, and passes a recording medium on which an unfixed toner image is held through a nip formed by the rotating member for heating and a rotating member for pressurizing which is pressed against the rotating member for heating to fix the toner image onto the recording medium with heating under pressure, the cylindrical heating element having high heating efficiency and being capable of detecting temperature of heat generated by the heat source so that fine control of the temperature can be achieved.

A second object of the present invention is to provide a fixing device which is employed in an image forming device operated by an electrophotographic system, electrostatic recording system or like system, and passes a recording medium on which an unfixed toner image is held through a nip formed by a rotating member for heating and a rotating member for pressurizing which is pressed against the rotating member for heating to fix the toner image on the recording medium with heating under pressure, the fixing device being capable of quickly and efficiently heating the rotating member for heating to a temperature at which the toner image can be fixed, compared with a conventional fixing device which employs a heat source comprising a hollow metal shaft having a heater incorporated therein as a heat source for a rotating member for heating, and therefore meeting the demand for a reduced warm-up time of the fixing device for the ease of use of the fixing device and thus of the image forming device, and the recent demand for energy saving, and also being able to perform fine control of temperature of the rotating member for heating.

In order to achieve the first object, one aspect of the present invention provides a cylindrical heating element comprising:

a cylindrical member;

a metallic pattern provided on at least one of outer and inner circumferential surfaces of the cylindrical member, which is capable of generating heat by being electrified; and a resistive pattern for detecting temperature provided on at least one of the outer and inner circumferential surfaces of the cylindrical member.

In order to achieve the second object, another aspect of the present invention provides a fixing device which passes a recording medium on which an unfixed toner image is held through a nip formed by a rotating member for heating and a rotating member for pressurizing which is pressed against the rotating member for heating to fix the toner image on the recording medium with heating under pressure, the rotating member for heating comprising a cylindrical heating element according to the present invention.

The foregoing and other objects, features, aspects and advantages of the present invention will become more apparent from the following detailed description of the preferred embodiments when taken in conjunction with accompanying drawings.

BRIEF DESCRIPTION OF THE DRAWINGS

FIG. 5 is a view showing still another example of a fixing device.

FIG. 6 is a front view of still another example of a cylindrical heating element.

FIG. 12(A) is a perspective view of another example of a flexible resin sheet on which a metallic pattern is formed; FIG. 12(B) is a view showing how the resin sheet is adhered on an outer circumferential surface of a cylindrical member; and FIG. 12(C) is a sectional view which shows an example of a heating roller for a fixing device, including a cylindrical heating element formed by the technique of FIGS. 12(A) and 12(B).

FIG. 17 is a schematic perspective view of still another example of a cylindrical heating element.

FIG. 18 is a view showing an example of a flexible resin sheet on which resistive patterns for detecting temperature are formed.

FIG. 19 is a view showing an example of a heating roller for fixing devices, including the cylindrical heating element in FIG. 17.

DESCRIPTION OF THE PREFERRED EMBODIMENTS

Figure 1A:
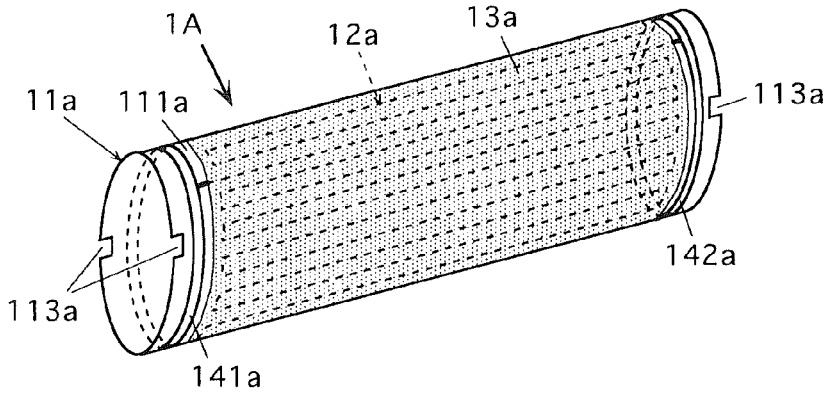
FIG. 1(A) is a perspective view of an example of a cylindrical heating element.

Embodiments of the present invention will be described below.

Cylindrical heating elements of the embodiments of the present invention include the following cylindrical heating element.

<Cylindrical Heating Element>

A cylindrical heating element comprising:

a cylindrical member;

a metallic pattern provided on at least one of outer and inner circumferential surfaces of the cylindrical member, which is capable of generating heat by being electrified; and a resistive pattern or detecting temperature provided on at least one of the outer and inner circumferential surfaces of the cylindrical member.

Herein, the "metallic pattern which is capable of generating heat by being electrified" means a pattern comprising a metal line which can generate heat by supplying it with an electric current (in other words, an electric power).

The "resistive pattern for detecting temperature" means a pattern which is made of a conductive line or the like whose electric resistance varies depending on changes in temperature, and can detect temperature based on the electric resistance.

Fixing devices of embodiments of the present invention include the following fixing device.

<Fixing Device>

A fixing device which passes a recording medium on which an unfixed toner image is held through a nip formed by a rotating member for heating and a rotating member for pressurizing which is pressed against the rotating member for heating to fix the toner image on the recording medium with heating under pressure, and the rotating member for heating comprising a cylindrical heating element according to the present invention.

In this fixing device, any of the following cases is included in the mode of pressing the rotating member for pressurizing against the rotating member for heating.

(1) The case where the rotating member for pressurizing whose rotation shaft is movable is pressed against the rotating member for heating whose rotation shaft is in place, (2) On the contrary, the case where the rotating member for heating whose rotation shaft is movable is pushed with respect to the rotating member for pressurizing whose rotation shaft is in place, whereby the rotating member for pressurizing is pushed relatively toward the rotating member for heating, (3) The case where the rotating member for heating and the rotating member for pressurizing are pressed against each other, whereby the rotating member for pressurizing is relatively pressed against the rotating member for heating.

The cylindrical heating element can be utilized as a heat source or the like of a rotating member for heating in a fixing device which is employed in an image forming device operated by an electrophotographic system, electrostatic recording system or like system, and passes a recording medium on which an unfixed toner image is held through a nip formed by the rotating member for heating and a rotating member for pressurizing which is pressed against the rotating member for heating to fix the toner image on the recording medium with heating under pressure.

Furthermore, a possible example is a case where the cylindrical heating element is a heating element for constituting at least a part of a rotating member for heating of a fixing device fixing an unfixed toner image on a recording medium by passing the recording medium on which the unfixed toner image is held through a nip formed by the rotating member for heating and a rotating member for pressurizing which is pressed against the rotating member for heating with heating under pressure.

In any case, the cylindrical heating element has, provided thereon, the metallic pattern being capable of generating heat by being electrified on at least one of the inner and outer circumferential surfaces of the cylindrical member. Therefore, heat can be efficiently generated directly from the metallic pattern by supplying the metallic pattern with electric current (in other words, by supplying an electric power to the metallic pattern), and the cylindrical member can be formed to have low heat capacity, whereby heat can be generated from the entire cylindrical heating element including the metallic pattern and the cylindrical member provided with the same with high efficiency, and energy saving can be achieved accordingly.

Since the cylindrical heating element comprises a resistive pattern for detecting temperature provided on at least one of the outer and inner circumferential surfaces of the cylindrical body, the temperature of the heat generated by the cylindrical heating element can be grasped precisely and finely from the resistive pattern, and fine control of the temperature of the heat generated toward a target temperature can be achieved.

Since the above-mentioned fixing device comprises the rotating member for heating having the cylindrical heating element which can efficiently generate heat, it can quickly and efficiently heat the rotating member for heating to a temperature at which the toner image can be fixed, compared with a conventional fixing device which employs a heat source comprising a hollow metal shaft having a heater incorporated therein as a heat source for the rotating member for heating. Therefore, it can meet the demand for a reduced warm-up time of the fixing device for the ease of use of the fixing device and thus of the image forming device, and the recent demand for energy saving.

Since the fixing device comprises the rotating member for heating which comprises the cylindrical heating element, and the cylindrical heating element comprises the resistive pattern for detecting temperature, the temperature of the heat generated by the cylindrical heating element can be grasped, and thus the temperature of the rotating member for heating can be grasped precisely and finely by the resistive pattern, and fine control of the temperature of the rotating member for heating toward a target temperature can be achieved.

The cylindrical heating element comprises, for example, the metallic pattern provided on one of the outer and inner circumferential surfaces of the cylindrical member, and the resistive pattern for detecting temperature provided on one of the outer and inner circumferential surfaces of the cylindrical member.

In this case, for example, the metallic pattern is provided on one of the outer and inner circumferential surfaces of the cylindrical member; an electric insulation film is formed on the metallic pattern; and the resistive pattern for detecting temperature is formed on the electric insulation film.

In order for the cylindrical heating element to be used as a rotating member for heating of a fixing device, an elastic material layer may be attached onto the outer circumferential surface side of the cylindrical member.

In this case, the elastic material layer may be covered with a wear-resistant film.

In order that the cylindrical heating element is used as at least a part of a rotating member for heating of a fixing device and for other applications, the metallic pattern may be divided into a plurality of patterns to provide divided heat generation zones (e.g., a heat generation zone for A4-sized recording medium and for a heat generation zone for A3-sized recording medium).

In this case, the resistive pattern may be provided to correspond to each of the divided metallic patterns.

The fixing device can comprise a power supply device for supplying a power to the metallic pattern of the cylindrical heating element of the rotating member for heating and a resistance detecting device for detecting the variation of electric resistance of the resistive pattern based on changes in temperature of the resistive pattern.

Furthermore, the fixing device can also comprise a control unit which controls a power fed to the metallic pattern from the power supply device so that the temperature of the rotating member for heating is controlled toward a predetermined target temperature based on a temperature difference between the temperature indicated (meant) by the electric resistance of the resistive pattern detected by the resistance detecting device and the predetermined target temperature of the rotating member for heating.

Cylindrical heating elements, fixing devices and other components will be described below with reference to drawings.

FIG. 1(A) is a perspective view of an example of a cylindrical heating element.

Figure 1B:
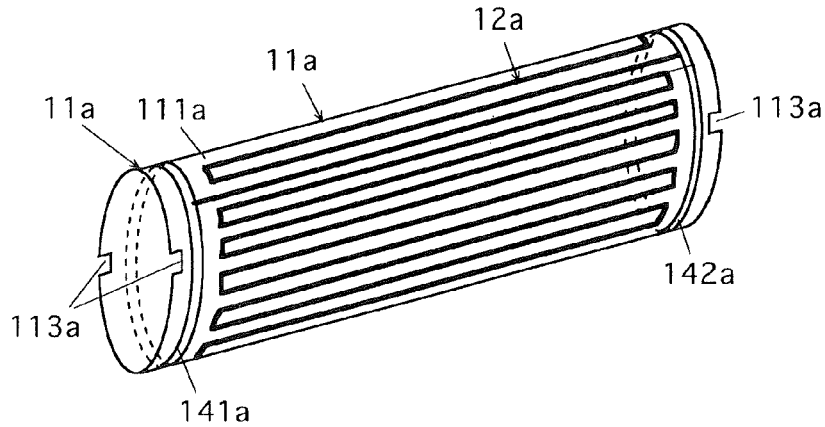
FIG. 1(B) is a perspective view of a state that an electric insulation film which covers a metallic pattern has been removed in the cylindrical heating element shown in FIG. 1(A).

The cylindrical heating element 1A in FIG. 1(A) comprises a cylindrical member 11*a* and a metallic pattern 12*a* being capable of generating heat by being electrified provided on an outer circumferential surface 111*a* of a cylindrical member 11*a*, and the metallic pattern 12*a* is covered with an electric insulation film 13*a*. FIG. 1(B) is a perspective view of a state that an electric insulation film which covers a metallic pattern has been removed in the cylindrical heating element shown in FIG. 1(A).

Herein, the term "metallic pattern" means a pattern comprising a metal line which can generate heat by supplying it with an electric current (in other words, an electric power).

The metallic pattern 12*a* herein is a pattern comprising a plurality of portions extending parallel to each other in the longitudinal direction of the cylindrical member 11*a* and extending in a zigzag pattern as a whole.

Ring-shaped electrode portions 141*a*, 142*a* for receiving electricity, which are electrically continuous with the metallic pattern 12*a*, are disposed on the outer circumferential surface at both end portions of the cylindrical member 11*a*. In this example, these ring-shaped electrode portions are formed integrally with the metallic pattern, and one end of the metallic pattern 12*a* is connected to one electrode portion 141*a*, while the other end of the metallic pattern 12*a* is continuous with the other electrode ring portion 142*a*.

The electric insulation film 13*a* covers the metallic pattern 12*a* in the area inside the ring-shaped electrode portions 141*a*, 142*a*.

The ring-shaped electrode portions may be provided separately from the metallic pattern 12*a* and then electrically connected with the metallic pattern 12*a*. Silver solder and so-called eyelets may be used as such an electrical connecting means. The ring-shaped electrode portions provided separately from the metallic pattern 12*a* may be reinforcements of the cylindrical member 11*a*.

Figure 2:
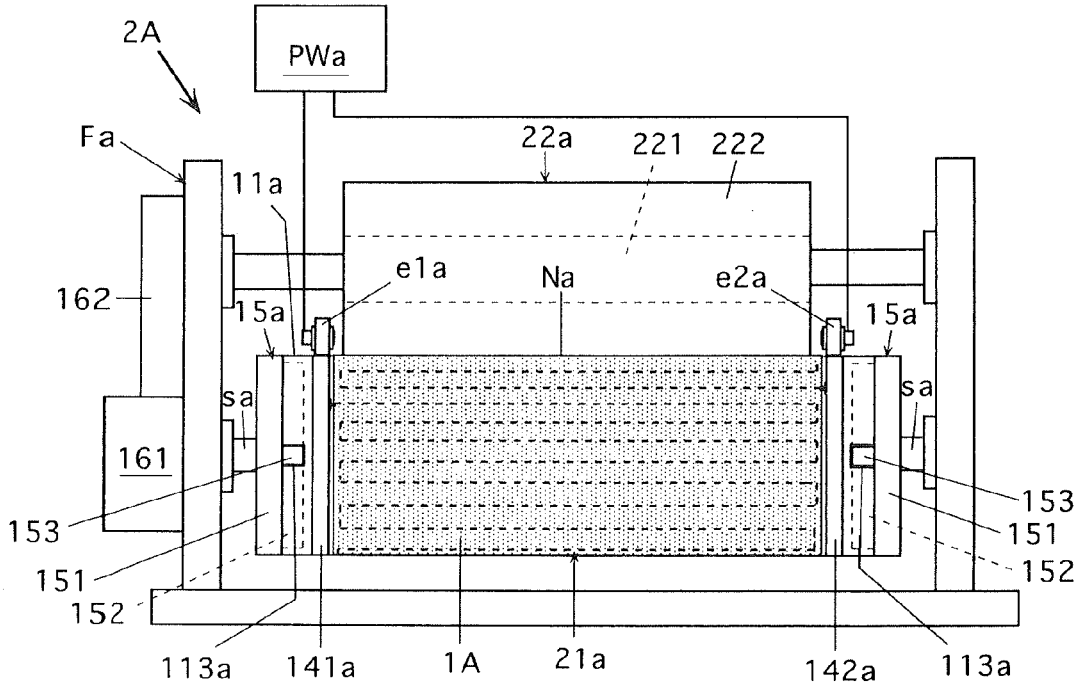
FIG. 2 is a front view of an example of a fixing device.
Figure 10:
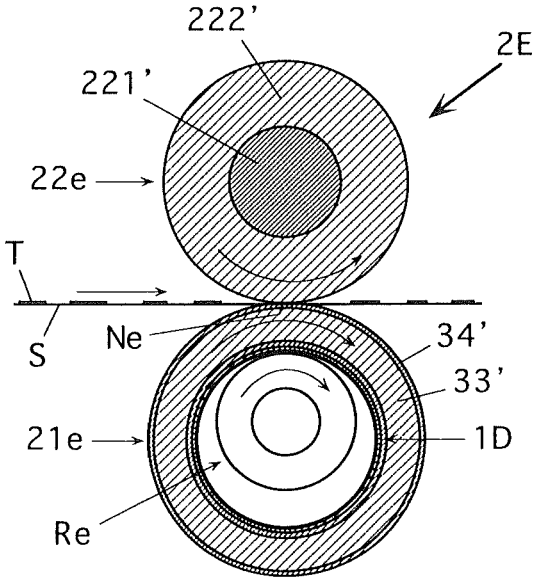
FIG. 10 is a view showing still another example of a fixing device.
Figure 14:
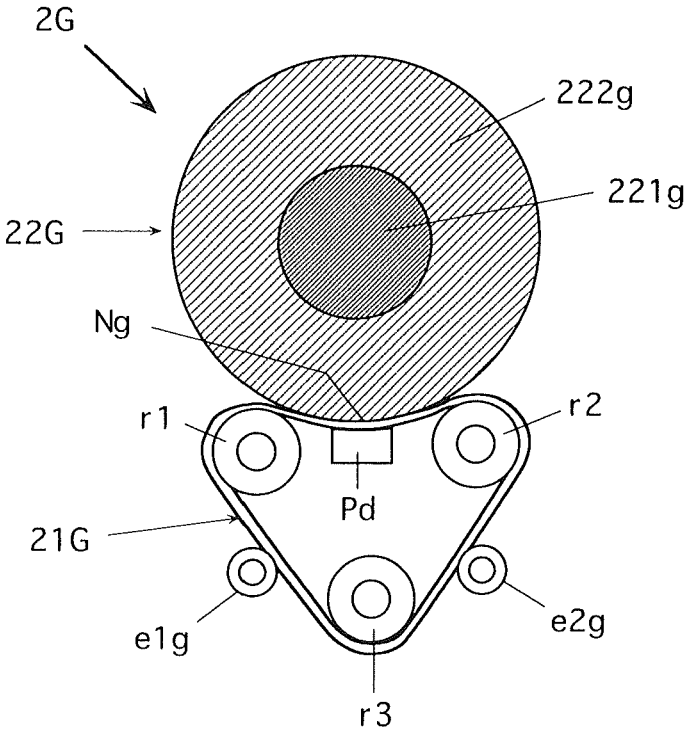
FIG. 14 is a view showing still another example of a fixing device.

At both ends of the cylindrical member 11*a*, a pair of engaging portions (engaging recesses) 113*a* which engage with end members 15*a* (see FIG. 2) for rotatably supporting this cylindrical heating element 1A, which are described later, are formed at each of both ends of the cylindrical member 11*a* at an interval of 180 degrees in central angle. As will be described later, the end member 15*a* to the left in FIG. 2 is a rotationally driven member, and therefore, in the example in FIG. 2, the cylindrical heating element 1A is a rotationally driven member in the fixing device 2A. However, when it is used to freely rotate by following the rotation of the rotating member for pressurizing without being driven (e.g., when used as shown in FIGS. 10, 14, etc.), the engaging portions 113*a* can be marks for alignment, and in some cases, the engaging portions 113*a* can be dispensed with.

The fixing device 2A in FIG. 2 is a fixing device which can be employed in image forming devices operated by electrophotographic system, electrostatic recording system and other systems. In this example, the fixing device 2A comprises a rotating member for heating 21*a* (hereinafter referred to as a heating roller 21*a*) in the form of a roller, and a rotating member for pressurizing 22*a* (hereinafter referred to as pressurizing roller 22*a*) in the form of a roller placed opposite to the rotating member for heating 21*a*.

The heating roller 21*a* uses the cylindrical heating element 1A in FIG. 1(A). That is, the heating roller 21*a* can rotate by fitting the end member 15*a* onto each of the end portions of the cylindrical member 11*a* of the cylindrical heating element 1A and rotatably supporting a rotation shaft sa of each of the end members 15*a* by a frame Fa.

The end member 15*a* comprises an outer disk portion 151 and an inner disk portion 152 having a slightly smaller diameter than the outer disk portion 151 which are stacked integrally in two layers with their centers aligned, and the rotation shaft sa integrally provided to protrude from the center of the outer surface of the outer disk portion 151. The inner disk portion 152 has a pair of projections 153 on its circumferential surface. Each of the end members 15*a* is attached to an end of the cylindrical member 11*a* at the inner disk portion 152, and the projection 153 is engaged with the engaging portion 113*a* of the cylindrical member 11*a*.

The pressurizing roller 22*a* comprises an elastic material layer 222 attached to a rotation shaft 221. The rotation shaft 221 is rotatably supported by the frame Fa, whereby the entire pressurizing roller 22*a* is rotatably supported by the frame. The elastic material layer 222 of the pressurizing roller 22*a* is pressed against the heating roller 21*a*, whereby a nip Na is provided between the heating roller 21*a* and pressurizing roller 22*a*.

The nip Na is a nip having a width (a length in the direction of passing of the recording medium) required for heating, melting and fixing the unfixed toner image onto the recording medium.

The shaft sa of one of the end members 15*a* of the heating roller 21*a* (the left shaft of the member 15*a* in FIG. 2) is connected to a rotary drive mechanism 161 comprising an electric motor (not illustrated), and the heating roller 21*a* can be rotated by the drive mechanism 161. At this time, one of the end members 15*a* of the cylindrical heating element 1A of the heating roller 21*a* is a rotational member rotated by the mechanism 161, and the heating roller 21*a* can be rotated by the rotation of the end member 15*a*.

The pressurizing roller 22*a* is rotationally driven by the drive mechanism 161 via a transmission mechanism 162 comprising gears and other parts in the direction opposite to the heating roller.

In this manner, the heating roller 21*a* and the pressurizing roller 22*a* can be rotated in such a direction that the recording medium is passed through the nip Na.

Power supply rollers e1*a*, e2*a*, which are examples of electrode portions for power supply, are in contact with the ring-shaped electrode portions 141*a*, 142*a* attached to the end portions of the cylindrical member 11*a* of the cylindrical heating element 1A constituting the heating roller 21*a* in a manner of allowing rolling contact. Power supply electrodes which are in sliding contact with the electrode portions 141*a*, 142*a* can be also employed in place of the power supply rollers.

The power supply rollers e1*a*, e2*a* are electrically connected to a variable-output power supply unit PWa.

According to the fixing device 2A described above, the toner image can be fixed onto the recording medium with heating under pressure by supplying an electric power from the power supply unit PWa to the metallic pattern 12*a* of the cylindrical heating element 1A of the heating roller 21*a* to cause the cylindrical heating element 1A to generate heat; further raising the temperature of the surface of the heating roller 21*a* to the toner image fixing temperature; rotating the heating roller 21*a* and the pressurizing roller 22*a* by the drive mechanism 161; and passing the recording medium on which the unfixed toner image is held (not illustrated in FIG. 2) with the surface of the recording medium on which the unfixed toner image is held facing the heating roller 21*a*.

The cylindrical heating element 1A constituting a main part of the heating roller 21*a* is provided with the metallic pattern 12*a* being capable of generating heat by being electrified on the outer circumferential surface of the cylindrical member 11*a*. Heat can be efficiently generated directly from the metallic pattern 12*a* by supplying power from the power supply unit PWa to the metallic pattern 12*a*. In addition, the cylindrical member 11*a* can be formed to have low heat capacity, whereby heat can be generated from the entire cylindrical heating element 1A including the metallic pattern 12*a* and the cylindrical member 11*a* provided with the same with high heating efficiency. Accordingly, the temperature of the heating roller 21*a* can be increased to a toner image fixing temperature quickly and efficiently, thereby meeting the demand for reduced warm-up time for the ease of use of the fixing device 2A and thus of the image forming device and recent demand for energy saving.

Although the cylindrical heating element 1A in FIG. 1 comprises the metallic pattern 12*a* provided on the outer circumferential surface 111*a* of the cylindrical member 11*a*, a metallic pattern may be provided on the inner circumferential surface of the cylindrical member, and metallic patterns being capable of generating heat by being electrified may be provided on both the inner and outer circumferential surfaces of the cylindrical member.

Figure 3:
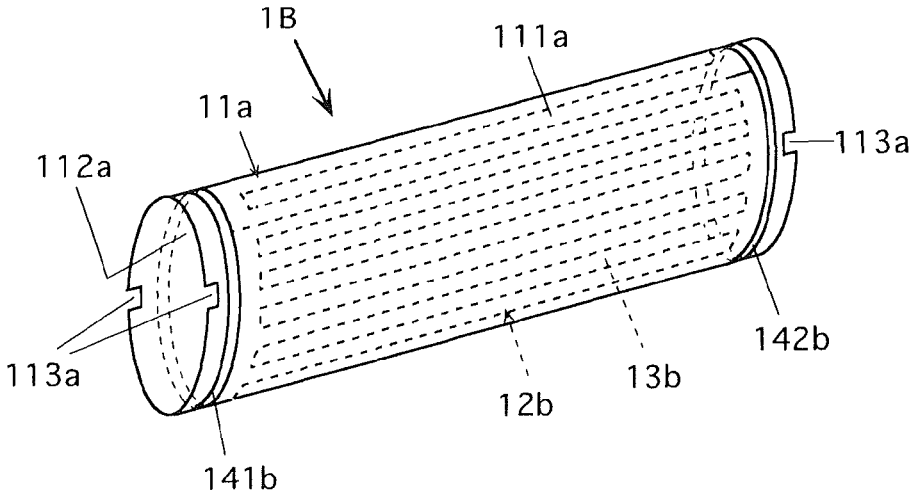
FIG. 3 is a perspective view of another example of a cylindrical heating element.

FIG. 3 shows a cylindrical heating element 1B constituted by providing a metallic pattern 12*b* on an inner circumferential surface 112*a* of a cylindrical member 11*a* in a zigzag pattern. The cylindrical member 11*a* in this example is the same as that of the cylindrical heating element 1A. The metallic pattern 12*b* is covered with an electric insulation film 13*b*. Ring-shaped electrode portions 141*b*, 142*b* are provided on the outer circumferential surface at both end portions of the cylindrical member 11*a*. The metallic pattern 12*b* is electrically connected to these electrode portions.

Figure 4:
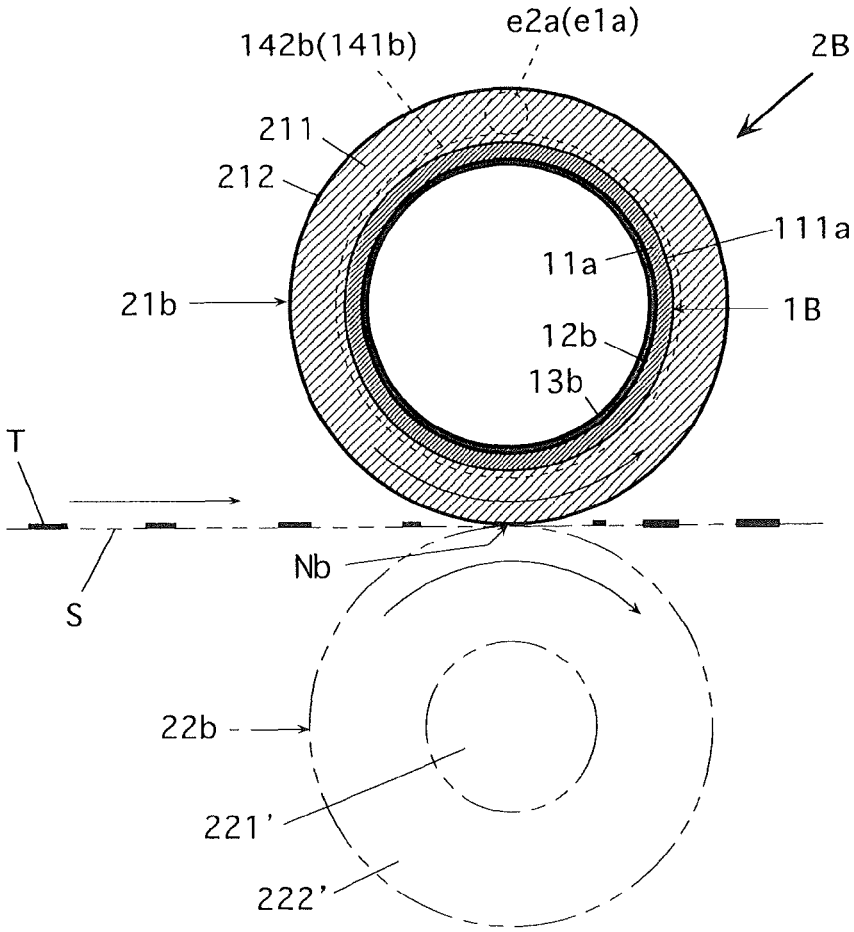
FIG. 4 is a view showing another example of a fixing device.

FIG. 4 shows an example of the fixing device 2B employed in image forming devices operated by electrophotographic system, electrostatic recording system and other systems. The fixing device 2B comprises a heating roller 21*b* and the pressurizing roller 22*b* placed opposite to the roller 21*b*.

The heating roller 21*b* uses the cylindrical heating element 1B in FIG. 3.

That is, the heating roller 21*b* is constituted by providing an elastic material layer 211 on the outer circumferential surface 111*a* of the cylindrical member 11*a* of the cylindrical heating element 1B in the area inside the ring-shaped electrode portions 141*b*, 142*b* while these electrode portions 141*b*, 142*b* are left exposed, covering the surface of the elastic material layer 211 by a wear-resistant film 212, and further attaching end members (not illustrated) similar to the end members 15*a* shown in FIG. 2 at both ends of the cylindrical member 11*a* to rotatably support the cylindrical member 11*a* on a frame, which is not illustrated, by a shaft sa protruding from the end members.

Although not restrictive, such an elastic material layer 211 can be obtained by, for example, resin molding, and the wear-resistant film 212 can be provided by, for example, covering the layer 211 with a tube made of a wear-resistant material.

The pressurizing roller 22*b* is constituted by attaching an elastic material layer 222' on a rotation shaft 221', and is rotatably supported by a frame, which is not illustrated. The pressurizing roller 22*b* is pressed against the heating roller 21*b* so that a nip Nb required for fixing an unfixed toner image T onto a recording medium S is formed.

The heating roller 21*b* and the pressurizing roller 22*b* can be driven to rotate by using a drive mechanism and a transmission mechanism similar to those in the case of the fixing device 2A in FIG. 2.

Ring-shaped electrode portions 141*b*, 142*b* are formed on the outer circumferential surface at both end portions of the cylindrical member 11*a*. These are electrically connected to a metallic pattern 12*b*. Power supply roller electrodes e1*a*, e2*a* are in contact with the electrodes 141*b*, 142*b* in a manner of allowing rolling contact, and these roller electrodes are connected to a variable-output power supply unit, which is not illustrated.

According to the fixing device 2B, the toner image T can be fixed onto the recording medium S with heating under pressure by supplying an electric power to the metallic pattern 12*b* from the power supply unit via the roller electrodes e1*a*, e2*a* and the ring-shaped electrode portions 141*b*, 142*b* of the cylindrical heating element 1B of the heating roller 21*b* to cause the cylindrical heating element 1B to generate heat and further increasing the temperature of the surface of the heating roller 21*b* to the toner image fixing temperature, and rotating the heating roller 21*b* and the pressurizing roller 22*b* to pass the recording medium S holding the unfixed toner image T through the nip Nb.

FIG. 5 shows still another example, fixing device 2C. The fixing device 2C is constituted by replacing the heating roller 21*b* in the fixing device 2B with the heating roller 21*c*, and is substantially the same as the fixing device 2B in the other respects.

The heating roller 21*c* is constituted by disposing a rotation shaft 213 within the cylindrical member 11*a* of the cylindrical heating element 1B in FIG. 3 and providing an elastic material layer 214 on the shaft to support the cylindrical heating element 1B by the rotation shaft 213 on a frame, which is not illustrated, so that it can be rotatably driven. In the roller 21C, the engaging portions 113*a* at both end portions of the cylindrical member 11*a* can be dispensed with.

When the heating roller 21*c* is employed, the cylindrical member 11*a* of the cylindrical heating element 1B may be formed thin enough to be deformed so that a nip having a more sufficient width for fixing the toner image is formed in contact rotation between the heating roller 21*c* and the pressurizing roller 22*b*.

Each of the metallic patterns 12*a*, 12*b* in the cylindrical heating elements 1A, 1B described above is a single continuous pattern, and uniformly generates heat throughout the entire of the cylindrical heating element, except both end portions of the cylindrical heating element.

However, when the cylindrical heating element is used as at least a part of the rotating member for heating of the fixing device, a heat generation zone or heat generation zones of the heating element may be varied depending on the size of recording medium to achieve energy saving and for other purposes because recording medium of various sizes are applied to the fixing device.

A cylindrical heating element 1C shown in FIG. 6 is an example of such a cylindrical heating element. The cylindrical heating element 1C is constituted by providing a zigzag metallic pattern 121*c* on the inner circumferential surface of the cylindrical member 11*a* at the center potion thereof and providing metallic patterns 122*c*, 123*c* having the same zigzag pattern on both sides of the pattern 121*c* on the inner circumferential surface of the cylindrical member 11*a*.

To one end portion of the outer circumferential surface of the cylindrical member 11*a* are attached the followings:

a ring-shaped electrode portion 141*c* electrically connected to one end of the pattern 121*c;* a ring-shaped electrode portion 142*c* electrically connected to one end portion of the pattern 122*c*; and a ring-shaped electrode portion 143*c* electrically connected to one end portion of the pattern 123*c*.

To the other end portion of the outer circumferential surface of the cylindrical member 11*a*, a common ring-shaped electrode portion 144*c* electrically connected to the other ends of the patterns 121*c*, 122*c* and 123*c* is attached.

In a fixing device which employs a heating roller using this cylindrical heating element, when a A4-size recording medium is passed through the fixing device in longitudinal orientation, only the pattern 121*c* is energized, while when a A3-size recording medium is passed through the fixing device in longitudinal orientation, all of the patterns 121*c*, 122*c* and 123*c* can be energized to generate heat.

Formation of the metallic patterns or further the ring-shaped electrode portions formed integrally with the metallic patterns in the cylindrical heating elements 1A, 1B, 1C described above can be performed, for example, by drawing or printing such patterns or electrode potions on at least one of the outer and inner circumferential surfaces of the cylindrical member 11*a* with a conductive paste (e.g., copper paste, silver paste) comprising a metallic material for forming the patterns or electrode portions.

As another method, the metallic patterns or electrode portions can be also formed by providing a conductive metal film on at least one of the outer and inner circumferential surfaces of the cylindrical member 11*a* on which the metallic patterns or the electrode portions are to be provided, forming resist patterns corresponding to the metallic patterns or electrode portions to be formed on the metal film, and etching the metal film with the portions covered with the resist left unetched.

In any case, the metallic patterns and electrode portions themselves can be formed by pattern formation techniques already known in the field of the formation of printed circuit boards and other devices.

Figure 7A:
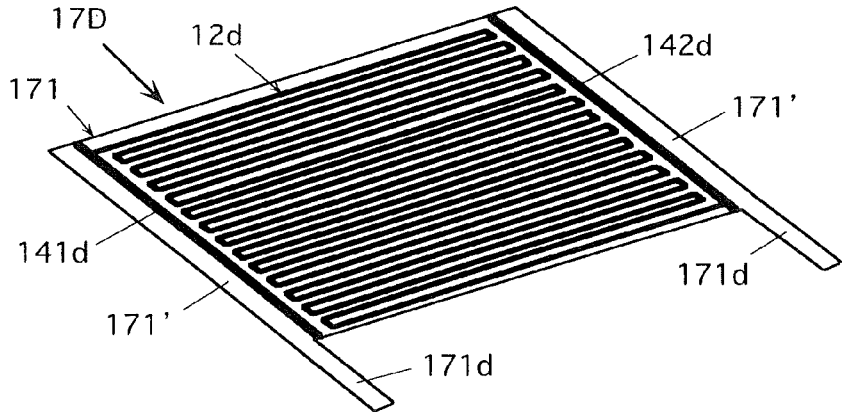
FIG. 7(A) is a perspective view of an example of a flexible resin sheet on which a metallic pattern is formed.
Figure 7B:
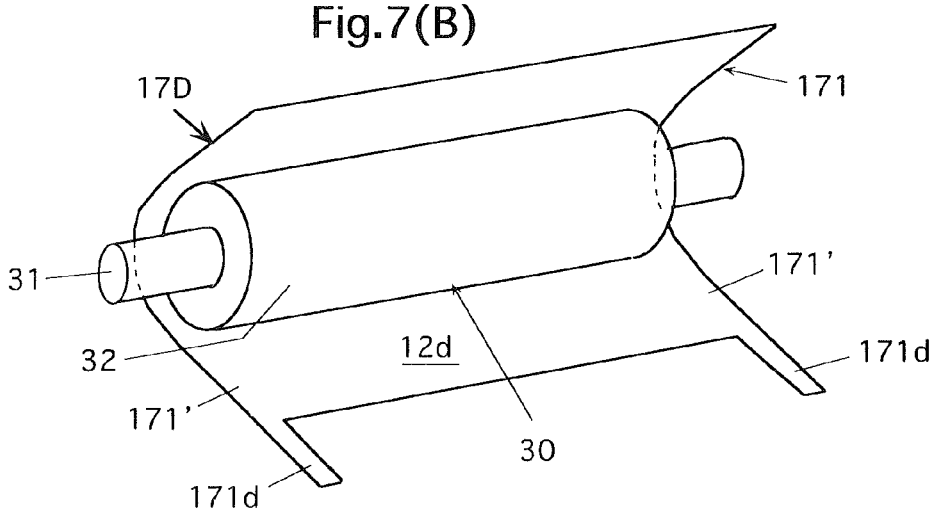
FIG. 7(B) is a perspective view which shows how the resin sheet is wound on a roll.
Figure 7C:
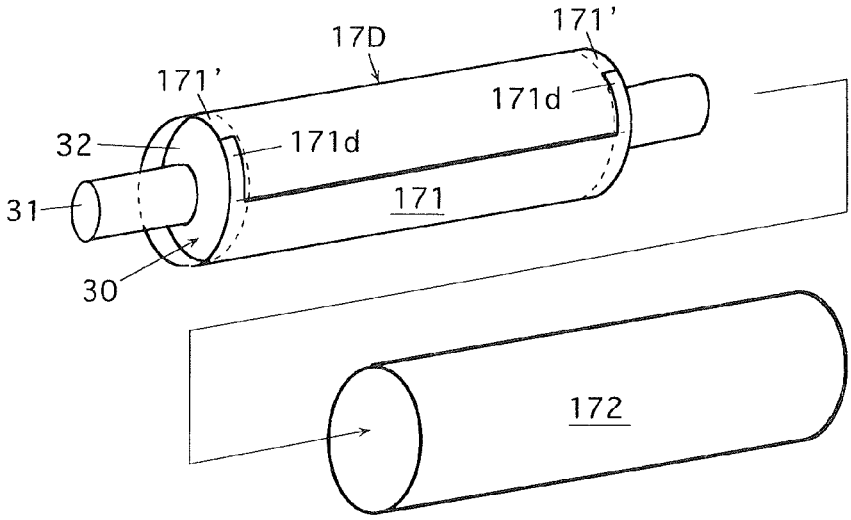
FIG. 7(C) is a view which shows how a rolled resin sheet is inserted into a cylindrical member and adhered onto its inner circumferential surface.

The cylindrical heating element can be also produced by the method shown in FIGS. 7(A) to 7(C). The basic manufacturing method of the cylindrical heating element shown in FIGS. 7(A) to 7(C) is as follows:

That is, a heat generating sheet 17D is formed by forming a metallic pattern 12*d* on a flexible resin sheet 171 (FIG. 7(A)), and this heat generating sheet 17D is rolled, inserted into a cylindrical member 172, and disposed on an inner circumferential surface of the cylindrical member 172 [refer to FIGS. 7(B) and 7(C)]. In this example, although not restrictive, the heat generating sheet 17D is rolled, inserted into the cylindrical member 172, and adhered onto the inner circumferential surface of the cylindrical member with an adhesive (it may be a sticky material).

More specifically, the flexible resin sheet 171 in this example is a sheet having a pair of tongue-shaped pieces 171*d* in an extending manner, and the pair of tongue-shaped pieces 171*d* is integrally provided to extend from a set of parallel side portions 171', 171' of two set of parallel side portions of the sheet 171. The metallic pattern 12*d* is formed on this sheet 171, while strip electrode portions (precursors of the ring-shaped electrode portions) 141*d*, 142*d* are formed on areas neighboring to the pattern 12*d*. The metallic pattern 12*d* may be covered with an electric insulation film. At this time, the electrode portions 141*d*, 142*d* are left exposed.

Meanwhile, a core roll 30 (FIG. 7(B)) is prepared by attaching an elastic material layer 32 to a shaft 31. The heat generating sheet 17D is wound onto the circumferential surface of the elastic material layer 32 of this core roll with its metallic pattern 12*d* facing inward and with the strip electrode portions 141*d*, 142*d* lying further out than opposite ends of the elastic material layer 32. Each of the tongue-shaped pieces 171*d* is adhered onto the outer circumferential surface of the side portion (lug portion) 171' of the sheet 171 with an adhesive. In this manner, as shown in FIG. 8 as an example, a cylindrical heating element 1D which can be used as a part of a heating roller 21*d* of a fixing device can be obtained.

In the cylindrical heating element 1D, the strip electrode portions 141*d*, 142*d* are rolled to form ring-shaped electrode portions.

In addition, the lug portions 171' of the sheet over which the tongue-shaped pieces 171*d* are overlaid in the cylindrical heating element 1D are located further out than the region through which the recording medium passes in the heating roller 21*d*, so that the smoothness of the area through which the recording medium passes is maintained. Furthermore, the portions overlaid in such a manner also serve as a reinforcement of the end portion of the cylindrical heating element 1D.

Figure 8:
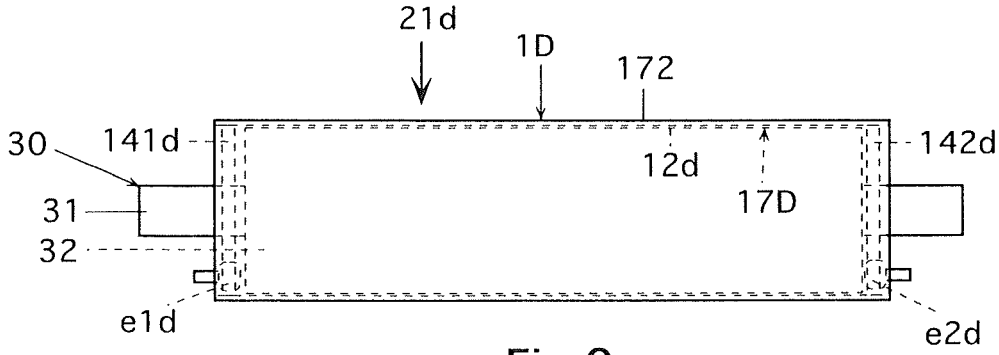
FIG. 8 is a view showing an example of a heating roller for a fixing device, including a cylindrical heating element formed by the technique shown in FIGS. 7(A) to 7(C).

In the heating roller 21*d* shown in FIG. 8, the cylindrical heating element 1D may be adhered to the elastic material layer 32 of the roller 30. The cylindrical heating element 1D may be merely disposed by attachment to the outside of the elastic material layer 32 without being adhered onto the same as long as it causes no inconvenience, e.g., its position is not changed on the roller 30. The heating roller 21*d* can be rotatably supported on a frame of the fixing device by the roller shaft 31, and can be used for fixing an unfixed toner image onto a recording medium in combination with a pressurizing roller supported by the frame. At this time, for example, electrodes for power supply e1*d*, e2*d* can be brought into rolling contact or sliding contact with the rotating ring-shaped electrode portions 141*d*, 142*d*, as shown in FIG. 8, to electrify the metallic pattern 12*d* via these electrodes and cause the cylindrical heating element 1D to generate heat, so that the temperature of the heating roller 21*d* can be increased to a toner image fixing temperature.

Figure 9:
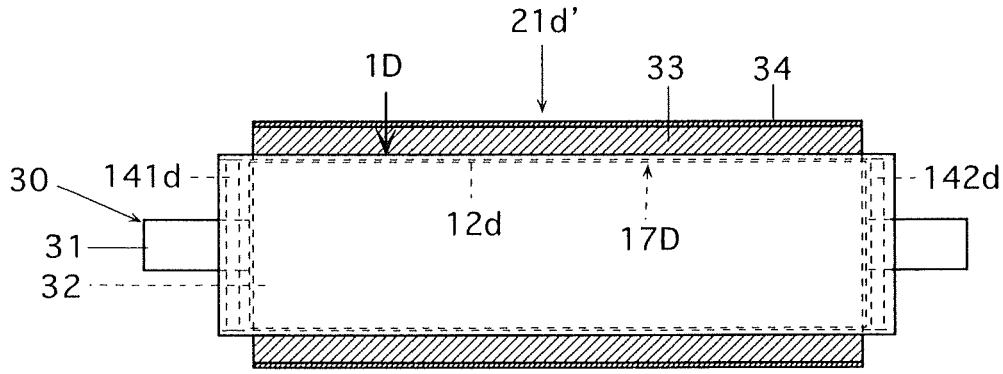
FIG. 9 is a view showing a modification to the heating roller of FIG. 8.

As shown in FIG. 9, an elastic material layer 33 can be attached onto the outer circumferential surface of the cylindrical member 172 of the cylindrical heating element 1D in the heating roller 21*d* in FIG. 8 (e.g., attached by resin molding), and its surface can be covered with a wear-resistant film 34. By providing the elastic material layer 33 in such a manner, a sufficient nip contributing to fixing a toner image on a recording medium can be easily obtained between the heating roller 21*d* and a pressurizing roller which is pressed against the roller 21*d*.

After the cylindrical heating element 1D is formed by the step shown in FIGS. 7(A) to 7(C), the roll 30 can be withdrawn from the heating element 1D, and the remaining cylindrical heating element 1D can be used as a part of the rotating member for heating of the fixing device.

FIG. 10 shows a schematic constitution of still another example, a fixing device 2E. The fixing device 2E is a fixing device which uses a belt-shaped heating rotation member 21*e* constituted by attaching an elastic material layer 33' onto the cylindrical heating element 1D from which the roll 30 is withdrawn by resin molding or other method, and covering the surface of the layer 33' with a wear-resistant film 34'.

The rotation belt 21*e* for heating is supported from inside by a rotatable roller Re, and a pressurizing roller 22*e* is pressed against the belt 21*e* in a manner of pinching the belt 21*e* between the roller 22*e* and the support roller Re. The pressurizing roller 22*e* is constituted by attaching an elastic material layer 222' onto a shaft 221', and can be driven to rotate in the counterclockwise direction in FIG. 10 by a driving mechanism, which is not illustrated.

According to the fixing device 2E, power is supplied from the ring-shaped electrode portions 141*d*, 142*d* and electrode portions for power supply (not illustrated) which are in contact with the ring-shaped electrode portions 141*d*, 142*d* to the metallic pattern 12*d* of the cylindrical heating element 1D of the belt 21*e* for heating, whereby the heating element 1D generates heat and the temperature of the belt 21*e* is raised to the fixing temperature. In addition, the pressurizing roller 22*e* is rotationally driven and the belt 21*e* for heating is rotated by following rotation in a state that the belt 21*e* for heating is supported by the support roller Re.

By passing a recording medium S retaining an unfixed toner image T through a nip Ne between the rotation belt for heating 21*e* and the pressurizing roller 22*e* in such a state, the toner image can be fixed on the recording medium S.

The roller Re may be also rotationally driven. In addition, a pad (not illustrated) which presses the belt 21*e* from inside against the pressurizing roller 22*e* can be also employed in place of the roller Re. At this time, the width of the nip Ne can be changed by selecting the size of the pad.

The cylindrical heating elements 1A, 1B, 1C described above can be also used as at least a part of a belt for heating by forming the cylindrical member 11*a* thinly enough to be bent.

When the cylindrical heating element is pressed to the pressing roller side from inside by a inner roller, pad or the like, in order to make a contact action between the inner roller, pad or the like and the cylindrical heating element smoother, the metallic pattern for heat generation may be provided on the outer circumferential surface of the cylindrical member. When a heat generating sheet provided with the metallic pattern is employed, the heat generating sheet may be disposed on the outer circumferential surface of the cylindrical member.

The metallic pattern 12*d* in the cylindrical heating element 1D is formed of a single continuous line, and uniformly generates heat approximately throughout its entire length. Accordingly, the cylindrical heating element 1D is uniformly heated except opposite end portions thereof. However, when the cylindrical heating element is used as at least a part of the rotating member for heating of the fixing device, the recording medium passing through the fixing device have various sizes. Therefore, heat generation zone(s) in the cylindrical heating element may be varied depending on the size of the recording medium to achieve energy saving and for other purposes.

Figure 11:
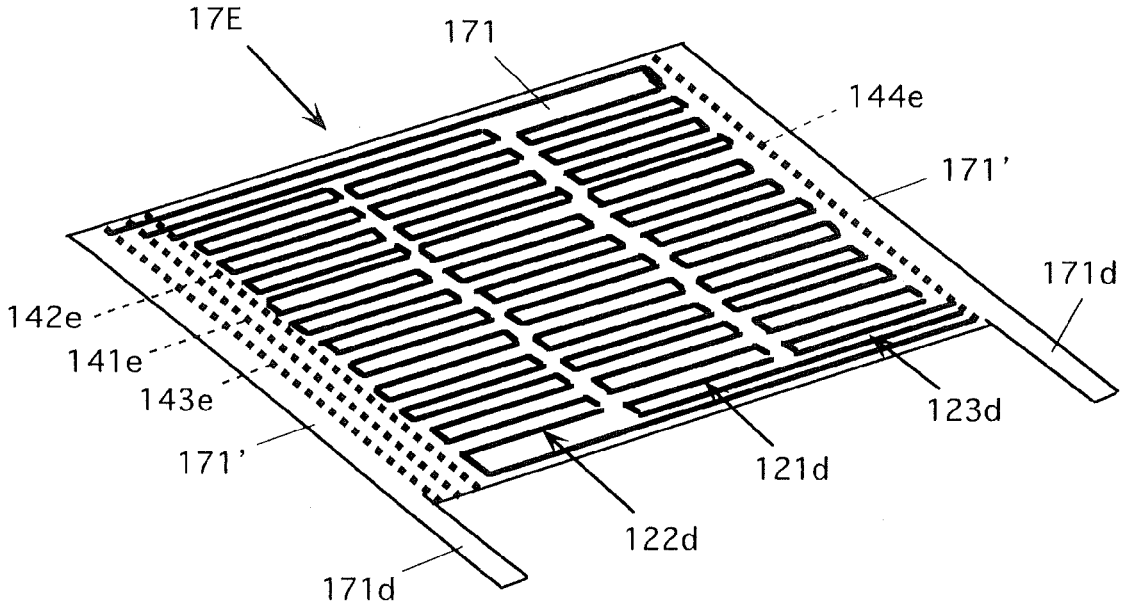
FIG. 11 is a perspective view of an example of a flexible resin sheet on which metallic patterns are divisionally formed.

Examples of the heat generating sheet for providing such a cylindrical heating element include that shown in FIG. 11. A heat generating sheet 17E shown in FIG. 11 is constituted by providing a metallic pattern 121*d* in a zigzag pattern in a central portion of a flexible resin sheet 171 similar to the resin sheet shown in FIG. 7(A), and providing metallic patterns 122*d*, 123*d* in a zigzag pattern at both sides of the pattern 121*d*.

On the side opposite to the surface on which the metallic patterns are provided at one of the two end portions of the flexible resin sheet 171 are formed a strip electrode portion 141*e* electrically connected to one end portion of the pattern 121*d*, a strip electrode portion 142*e* electrically connected to one end portion of the pattern 122*d*, and a strip electrode portion 143*e* electrically connected to one end portion of the pattern 123*d*. On the side opposite to the surface on which the metallic patterns are provided at the other end portion of the sheet 171 is formed a common strip electrode portion 144*e* electrically connected to the other ends of the patterns 121*d*, 122*d* and 123*d*.

According to this heat generating sheet 17E, the cylindrical heating element can be also obtained by rolling this and adhering or merely disposing this at the inner circumferential surface of the cylindrical member or by other means.

The cylindrical heating element can be also produced by the method shown in FIGS. 12(A) to 12(C). The basic manufacturing method of the cylindrical heating element shown in FIGS. 12(A) to 12(C) is as follows:

That is, a metallic pattern 12*f* is formed on a flexible resin sheet 171*f* to form a heat generating sheet 17F (FIG. 12(A)), and rolling this heat generating sheet 17F and disposing this on an outer circumferential surface of a cylindrical member 11*a* (FIG. 12(B)). At this time, the heat generating sheet 17F may be adhered to the outer circumferential surface of the cylindrical member 11*a* with an adhesive, or may be merely disposed without adhering, as long as it causes no inconvenience, for example, there is no possibility that the sheet is shifted relative to the cylindrical member.

Explained in further detail, the metallic pattern 12*f* is formed on the surface of the flexible resin sheet 171*f* in the shape of a quadrangle shape, and strip electrode portions (precursors of the ring-shaped electrode portions) 141*f*, 142*f* are formed on both outer sides of the pattern 12*f*. Thus, the heat generating sheet 17F is obtained. The metallic pattern 12*f* may be covered with an electric insulation film. At this time, the electrode portions 141*f*, 142*f* are left exposed.

This heat generating sheet 17F is wound onto the outer circumferential surface of the cylindrical member 11*a* and adhered thereto with an adhesive, or securely wound and disposed thereon without adhering. In such a way, the cylindrical heating element 1F is obtained. In this example, in order to use the heating element 1F as the rotating member for heating of the fixing device, an elastic material layer 35 is attached to the cylindrical heating element 1F by resin molding or other means as shown by the broken chain line in FIG. 12(B), and as shown in FIG. 12(C). The surface of the elastic material layer 35 is covered with a wear-resistant film 36, such as a wear resistance film tube.

Figure 13:
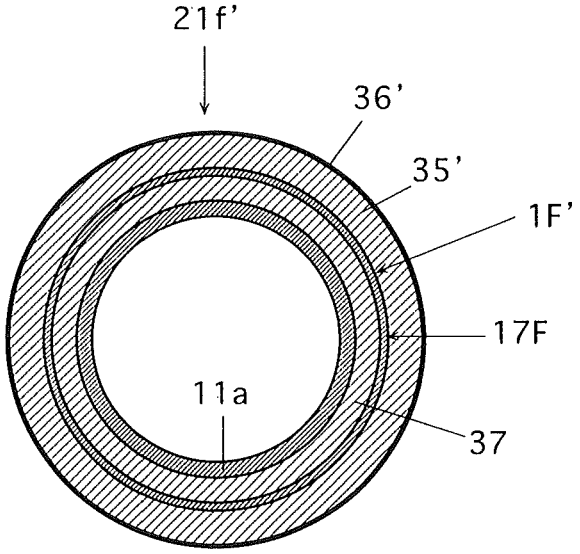
FIG. 13 is a sectional view of still another example of a heating roller.

As shown in FIG. 13, the following constitution may be also employed: an elastic material layer 37 is attached onto the outer circumferential surface of the cylindrical member 11*a*; the heat generating sheet 17F is wound thereon to form a cylindrical heating element 1F'; an elastic material layer 35' is attached further thereon. The layer 35' may be covered with a wear-resistant film 36'.

The heat generating sheet disposed on the outer circumferential surface of the cylindrical member is not limited to that in FIG. 12(A), and may be such that is provided with more than one groups of the metallic patterns, such as the heat generating sheet 17E shown in FIG. 11.

In any case, the cylindrical member 11*a* is the same as the cylindrical member 11*a* used in the cylindrical heating element 1A in FIG. 1. Therefore, as in the case of the cylindrical heating element 1A, the cylindrical member can be used as a main portion of the rotating member for heating of the fixing device by attaching end members 15*a* at their both ends or by other means.

However, the cylindrical member on which the heat generating sheet is disposed need not be the cylindrical member 11*a*, and may be a cylindrical member having no engaging portion 113*a*. Its thickness may be also small so that it exhibits flexibility.

FIG. 14 shows still another example, a fixing device 2G. The fixing device 2G comprises a rotating member for heating 21G and a pressurizing roller 22G which is rotated while it is in contact with this rotating member for heating. The rotating member for heating 21G is constituted by winding a flexible heat generating sheet 17F shown in FIG. 12(A) on an outer circumferential surface of the cylindrical member thinly formed and exhibiting flexibility, and adhering the sheet thereon to form the rotating member 21G for heating in the form of a belt.

The pressurizing roller 22G is constituted by attaching an elastic material layer 222*g* to a rotation shaft 221*g*. The rotation belt for heating 21G is wound on guide rollers r1, r2, r3, and is pressed by a pad Pd between the guide rollers r1 and r2 on the pressurizing roller to form a wide nip Ng between itself and the pressurizing roller 22G. By passing a recording medium on which an unfixed toner image is retained through this nip Ng, the toner image can be fixed onto the recording medium.

Figure 15:
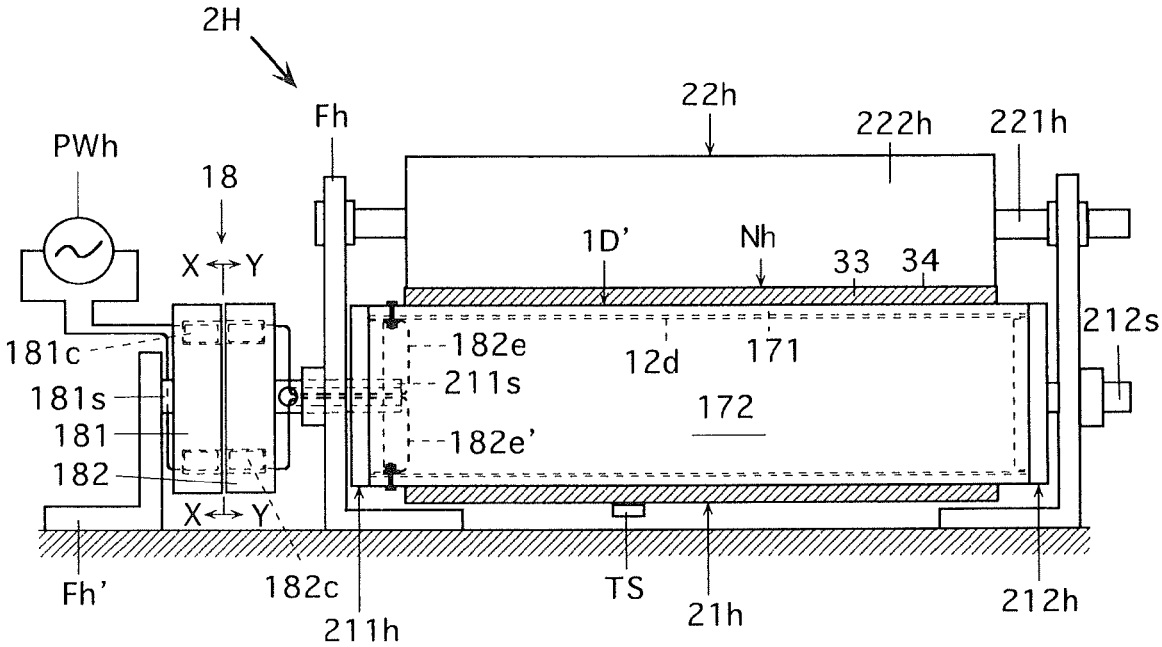
FIG. 15 is a front view of still another example of a fixing device.

FIG. 15 shows still another example, a fixing device 2H. The fixing device 2H comprises a heating roller 21*h* and a pressurizing roller 22*h* pressed against the heating roller 21*h*.

The heating roller 21*h* is a modification of the heating roller shown in FIG. 9 mentioned previously. Furthermore, the heating roller 21*h* uses a cylindrical heating element 1D' formed by omitting the ring-shaped electrode portions 141*d*, 142*d* at both end portions in the cylindrical heating element 1D constituting the heating roller 21*d'* in FIG. 9, that is, the cylindrical heating element 1D constituted by rolling the heat generating sheet 17D comprising the flexible resin sheet 171 on which the metallic pattern 12*d* is provided and adhering it onto the inner circumferential surface of the cylindrical member 172.

An elastic material layer 33 is attached to the cylindrical member 172 of the cylindrical heating element 1D' as in the cylindrical heating element 1D, and its surface is covered with a wear-resistant film 34. End members 211*h*, 212*h* are attached to both end portions of the cylindrical member 172. The end members 211*h*, 212*h* have such a constitution that their disc-like portions are integrally stacked in two layers as the end members 15*a* of the heating roller 21*a* of the fixing device 2A shown in FIG. 2, and the small-diameter disc-like portion is fitted into the end portion of the cylindrical heating element 1D'.

The heating roller 21*h* is rotatably supported on a fixing device frame Fh by a shaft 211*s* protruding from the end member 211*h* and a shaft 212*s* protruding from the end member 212*h*.

The pressurizing roller 22*h* is constituted by attaching an elastic material layer 222*h* onto the shaft 221*h*, and is rotatably supported on the frame Fh and pressed against the heating roller 21*h*, forming a nip Nh between itself and the heating roller 21*h*.

One of the shafts 212*s* of the heating roller 21*h* can be driven to rotate by a rotary drive, which is not illustrated, and the pressurizing roller 22*h* can be driven to rotate by the rotary drive via a transmission mechanism, which is not illustrated.

Figure 16A:
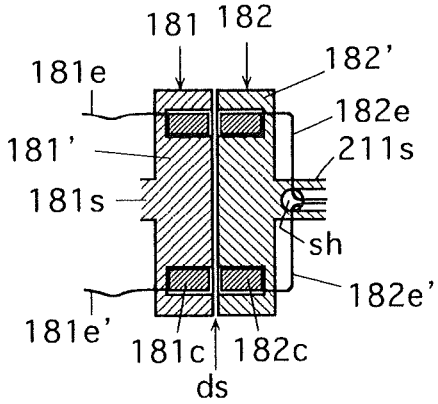
FIG. 16(A) is a sectional view of a part of a power supplying device to the heating roller in the fixing device shown in FIG. 15, and FIGS. 16(B) and 16(C) are views which show first and second portions of the power supplying device seen from direction X and direction Y in FIG. 15, respectively.

The fixing device 2H comprises a power supply device 18 which electrify the metallic pattern 12*d* of the cylindrical heating element 1D'. FIG. 16(A) is a sectional view showing an essential part of the power supply device 18. The device 18 comprises, as shown in FIGS. 15 and 16(A), a first portion 181, and a second portion 182 which is the same as the first portion but facing the first portion 181 symmetrically.

The first portion 181 is constituted by disposing a primary coil 181*c* on a disc-like first core member 181' in a manner of winding, while the second portion 182 is constituted by disposing a secondary coil 182*c* on a disc-like second core member 182' in a manner of winding. The core members 181', 182' are formed of a material (which can be a core for an electromagnet), that is, magnetic substance (ferrite in this example).

The first portion 181 is supported on a fixedly positioned frame Fh' by a shaft 181*s* protruding toward opposite to the second portion 182 from the core member 181', and is statically disposed. The shaft 211*s* protruding from the end member 211*h* of the heating roller 21*h* is connected to and fixed on a side opposite to the first portion 181 of the core member 182' of the second portion 182. In this manner, in a state that the central axes of the first portion 181 and the second portion 182 are aligned, the first portion 181 and the second portion 182 oppose each other at a gap ds between flat planes on which those core members face each other.

Although not restrictive, the areas of the portions of the flat planes of the core members are the same in this example.

Figure 16B:
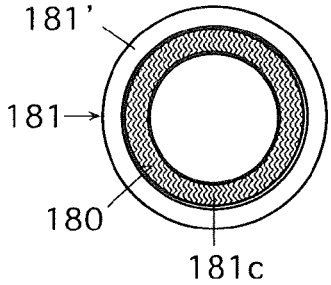
Figure 16C:
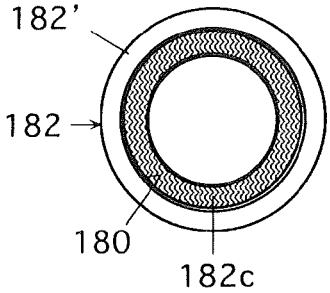

FIG. 16(B) is a view showing the first portion 181 seen along the direction of arrow X shown in FIG. 15, while FIG. 16(C) is a view showing the second portion 182 seen along the direction of arrow Y shown in FIG. 15.

On each of the core member planes opposing each other of the first and second portions 181, 182, a circular groove 180 having the same size as the first and second portions is formed with its center aligned with the center axes of the shafts 181S, 211*s* and same size, and the coil is wound in this circular groove 180.

The coil 181*c* wound on the core member 181' of the first portion 181 is a primary coil. Both end portions 181*e*, 181*e'* of this coil are drawn from the first portion 181 opposite to the second portion 182, and are connected to a variable-output alternating-current power supply unit PWh.

The coil 182*c* wound on the core member 182' of the second portion 182 is a secondary coil. Both end portions 182*e*, 182*e'* of the this coil are drawn from the second portion opposite to the first portion 181 through the second portion 182, further guided to a hollow portion of the end member shaft 211*s*, reaches the inside of the cylindrical heating element 1D' through the hollow portion, and are connected to a metallic pattern 12*d*.

The first portion 181 provided with the primary coil 181*c* and the second portion 182 provided with the secondary coil 182*c* are, so to speak, separating transformers formed by separating a transformer in a middle potion thereof. An induced current flows to the secondary coil 182*c* of the second portion 182 by mutual induction by flowing an alternating current from the power supply unit PWh to the primary coil 181*c*, whereby the metallic pattern 12*d* is energized; the cylindrical heating element 1D' generates heat; and the temperature of the surface of the heating roller 21*h* is raised to such a temperature at which an unfixed toner image can be fixed onto a recording medium.

The temperature control of the heating roller may be performed by detecting the temperature of the surface of the heating roller 21*h* with an appropriate temperature sensor TS such as a thermistor, and adjusting the output of the power supply unit PWh, based on the difference between a detected temperature and a target temperature (e.g., about 180° C.), so that the detected temperature is changed toward the target temperature.

In general, the output of the power supply unit PWh is not critical as long as it is an alternating-current power. Examples include currents at frequencies ranging from about 50 Hz to 60 Hz (90V to 240V) from commercial power sources to about 100 kHz. However, employing a high-frequency power enables the first and second portions to be smaller since their volumes, which are affected by the core member and the winding number of the coils, can be reduced. Therefore, in order to reduce the sizes of the first and second portions 181, 182 (especially the sizes of the core members 181', 182'), and in consideration of power transfer efficiency, the frequency can be controlled, for example, within a range from 1 kHz to 100 kHz. In this example, the frequency can be controlled within a range from 20 kHz to 40 kHz as a more preferably range.

The control of the output of the unit PWh may be conducted by varying the duty ratio of waveforms by PWM control.

In any case, fine control of the temperature can be performed.

Generally speaking, the gap ds between the flat planes of the first and second core members 181', 182' may be, for example, 0.1 mm or more to avoid contact between both members. In addition, although depending on the winding numbers of the primary and secondary coils, the materials of the core member 181', 182' and other conditions, the gap between the flat planes of the first and second core members may be, for example, about 10 mm at most in general, in order to cause the secondary coil 182*c* to generate an induced current which can change the temperature of the surface of the heating roller toward a predetermined temperature.

Although depending on the winding numbers of the primary and secondary coils, the materials of the core members 181', 182', and the gap (interval) between the members 181', 182', the proportion of the portion in the flat plane of the first core member 181' which faces the second core member 182' to the entire area of the flat plane (and the proportion of the portion in the flat plane facing the first core member 181' of the second core member 182' to the entire area of the flat plane) maybe, for example, 50% or higher in general, in order to generate an induced current which can change the temperature of the surface of the heating roller toward a predetermined temperature more securely and efficiently.

Inside the cylindrical heating element 1D' of the heating roller 21*h* may be provided a supporting elastic material made of a sponge or the like in a position corresponding to the passage area of the recording medium by resin molding or other means. A power supply device similar to the power supply device 18 described above can be also applied, as shown in FIG. 15, not only for energization of the metallic pattern 12*d* of the cylindrical heating element 1D' of the heating roller 21*h*, but also for energization of metallic patterns of other cylindrical heating elements described in this specification and metallic patterns of similar cylindrical heating elements, as long as no inconvenience is caused, for example, in terms of structure.

FIG. 17 shows still another example, a cylindrical heating element 1J. The cylindrical heating element 1J is constituted by providing a metallic pattern 12*j*1 on the center and metallic patterns 12*j*2, 12*j*3 on its both side on the outer circumferential surface of a cylindrical member 11*j*, attaching ring-shaped electrode portions 141*j*, 142*j*, 143*j*, 144*j* on the outer circumferential surface of one side of the cylindrical member 11*j*, and also providing a resistive pattern for detecting temperature (resistive pattern whose electric resistance varies depending on changes in temperature comprising a conductive line such as copper line) on the inner circumferential surface of the cylindrical member 11*j*.

Although not illustrated, components on the outer circumferential surface of the cylindrical member are each connected in the following manner:

the ring-shaped electrode portion 141*j* is connected to one end of the metallic pattern 12*j*1;

the ring-shaped electrode portion 142*j* is connected to one end of the metallic pattern 12*j*2;

the ring-shaped electrode portion 143*j* is connected to one end of the metallic pattern 12*j*3; and the ring-shaped electrode portion 144*j* is connected to the other end of the each metallic pattern.

The resistive pattern for detecting temperature on the inner circumferential surface of the cylindrical member 11*j* is, but is not limited to, provided as follows in this example:

As shown in FIG. 18, a central resistive pattern sj1 is formed and resistive patterns sj2, sj3 are formed on both its sides on one side of a flexible resin sheet 19; strip electrode portions 1*s*, 2*s*, 3*s*, 4*s* are formed on one end portion of the other side of the sheet; the resin sheet 19 is rolled with the side on which the resistive patterns are provided facing outside and is inserted into the cylindrical member 11*j* to dispose the sheet on the inner circumferential surface of the cylindrical member 11*j*. In this example, the resin sheet 19 is adhered onto the inner circumferential surface of the cylindrical member 11*j* with an adhesive, but it may be merely disposed inside the cylindrical member as long as it causes no inconvenience, e.g., there is no possibility of dispositioning.

The resistive patterns sj1, sj2, sj3 are all patterns comprising metal line whose electric resistance vary depending on changes in temperature in this example.

In a state that the resin sheet 19 is disposed on the inner circumferential surface of the cylindrical member 11*j* in such a manner, the resistive pattern sj1 corresponds to the metallic pattern 12*j*1; the resistive pattern sj2 to the metallic pattern 12*j*2; and the resistive pattern sj3 to the metallic pattern 12*j*3.

The strip electrode portions 1*s*, 2*s*, 3*s*, 4*s* serve as ring-shaped electrode portions in a state that the resin sheet 19 is rolled and disposed on the inner circumferential surface of the cylindrical member 11*j*, which are left exposed.

Although not illustrated, on the inner circumferential surface side of the cylindrical member 11*j*, the electrode portion 1*s* is connected to one end of the resistive pattern sj1;

the electrode portion 2*s* is connected to one end of the resistive pattern sj2;

the electrode portion 3*s* is connected to one end of the resistive pattern sj3; and the electrode portion 4*s* is connected to the other end of each resistive pattern.

When the cylindrical heating element 1J is used as a part of a heating roller for fixing devices, a rotatable heating roller 21*j* can be obtained, for example, as shown in FIG. 19, by attaching an elastic material layer 41 to the cylindrical heating element 1J, covering its surface with a wear-resistant film 42, attaching appropriate end members to the end portions of the cylindrical heating element 1J, and supporting this on a frame of the fixing device by a shaft. In this case, the end members may be attached at the farther side of these electrode portions 1*s* to 4*s* so that electrodes for detecting the electric resistance can be brought into contact with the ring-shaped electrode portions 1*s* to 4*s* from outside.

Depending on the size of the recording medium subjected to fixing of a toner image, at least one of the metallic patterns 12J1 to 12J3 is electrified by a variable-output power supply unit (not illustrated) via some of the electrodes for power supply (not illustrated) and the ring-shaped electrode portions 141*j* to 144*j* to cause a predetermined range of the cylindrical heating element 1J to generate heat, whereby the temperature of a predetermined range of the heating roller 21*j* can be raised toward the toner image fixing temperature.

Heat generation is caused by energization of at least one of the metallic patterns 12*j*1 to 12*j*3. The variation of electric resistance of each resistive pattern caused by changes in temperature of the metallic pattern, corresponding to the resistive pattern, which generate heat can be detected by a resistance detector via at least some of the ring-shaped electrode portions 1*s* to 4*s* and the detecting electrodes for detecting electric resistance which are brought into contact with the electrode portions 1*s* to 4*s*, which are not illustrated. Accordingly, the temperature of the portion of the heating roller 21*j* heated by the heat generated by the metallic pattern(s) can be grasped. Therefore, power supplied from the power supply unit to the metallic patterns can be controlled in a control unit which receives detection information corresponding to temperature from the resistance detector, which is not illustrated, based on a difference between the temperature detected by the resistive pattern(s) and a target temperature, by frequency control, PWM control or other means, and the temperature of the heating roller 21*j* can be controlled finely, precisely and stably toward a predetermined fixing temperature in a predetermined range.

When the frequency of the power supply unit output is controlled, the resistance of the resistive patterns may be grasped by converting the resistance of the resistive patterns to frequency in advance, and by converting the variation of the resistance of the resistive patterns into the variation of frequency.

Figure 20:
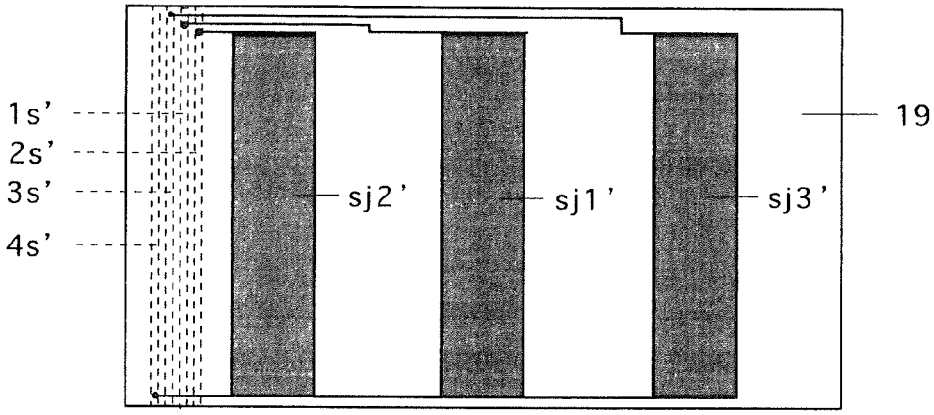
FIG. 20 is a view showing another example of a flexible resin sheet on which resistive patterns for detecting temperature are formed.

The flexible resin sheet shown in FIG. 20 is constituted by print-forming, on the sheet surface of the resin sheet 19, a resistive pattern sj1' so as to correspond to the metallic pattern 12*j*1, a resistive pattern sj2' so as to correspond to the metallic pattern 12*j*2, and a resistive pattern sj3' so as to correspond to the metallic pattern 12*j*3, instead of forming a group of resistive patterns sj1, sj2 and sj3 by wiring on the surface of the flexible resin sheet 19. Each of the resistive patterns sj1', sj2', sj3' herein is a strip pattern made by coating with a conductive paste such as copper paste and silver paste whose electric resistance varies depending on changes in temperature.

On the end portion of the opposite side surface of the sheet 19 on which the resistive patterns sj1', sj2' and sj3' are not formed, strip electrode portions 1*s*' to 4*s*', which are to be ring-shaped electrode portions electrically connected to the resistive patterns sj1', sj2' and sj3', are formed.

Figure 21:
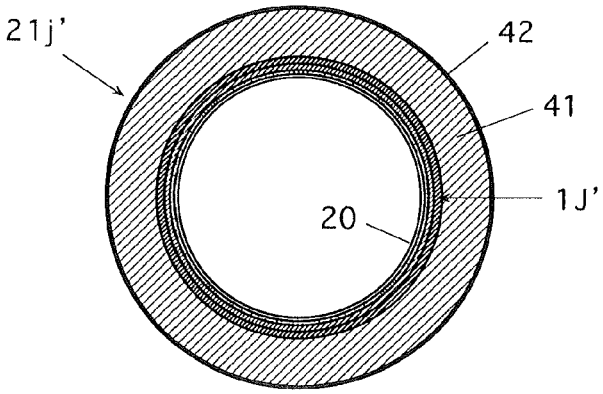
FIG. 21 is a view showing still another example of a heating roller for fixing devices.
Figure 22:
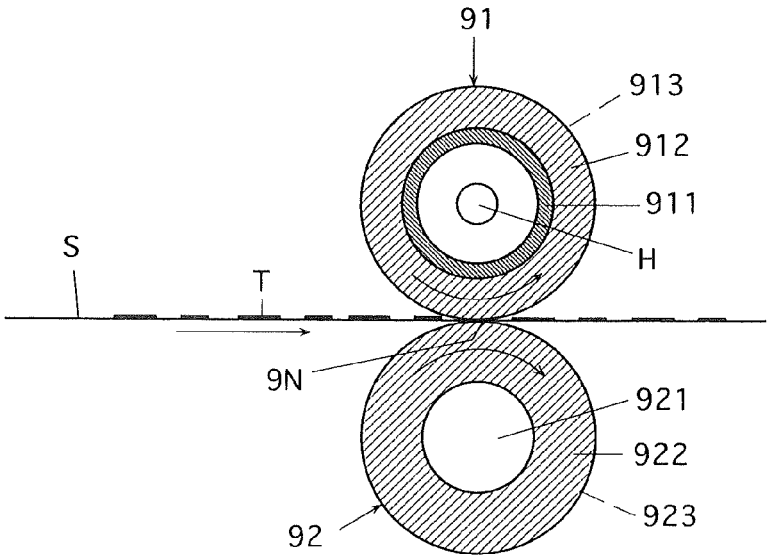
FIG. 22 is a view showing an example of conventional fixing devices.

This sheet can be also rolled with the surface on which the resistive patterns sj1' to sj3' are provided facing outside, inserted into the cylindrical member 11*j*, and disposed on the inner circumferential surface of the cylindrical member 11*j* by adhesion with an adhesive, by mere disposition or by other means to form a cylindrical heating element 1J' (see FIG. 21). Furthermore, a heating roller 21*j*' as shown in FIG. 21 can be formed by attaching an elastic material layer 41 onto an outer circumferential surface of the cylindrical heating element 1J', and covering its surface with a wear-resistant film 42.

In this heating roller 21*j*', the heat generation is caused by electrifying at least one of the metallic patterns 12J1 to 12J3. The variation of electric resistance of the resistive patterns caused by changes in temperature in response to heat generation of the metallic patterns can be detected via at least some of the ring-shaped electrode portions 1*s* to 4*s* and detection electrodes (not illustrated) brought into contact with these electrode portions. Accordingly, the temperature of the portion of the heating roller 21*j* heated by the heat generated by the metallic pattern(s) can be grasped. Therefore, power supplied from the power supply unit to the metallic patterns can be controlled based on a difference between the temperature detected by the resistive patterns and a target temperature, and the temperature of the predetermined range of the heating roller 21*j*' can be precisely controlled toward a predetermined fixing temperature.

The resistive patterns for detecting temperature (patterns provided by wiring, patterns of coated strips, etc.) can be provided not only on the cylindrical heating elements 1J, 1J' described above, but also on other cylindrical heating elements described in the specification and similar cylindrical heating elements, as long as no inconvenience is caused, so that the resistive patterns can be used to control the temperature of the cylindrical heating elements and the rotating bodies for heating of the fixing devices using the same. In any case, the resistive patterns for detecting temperature can be also formed directly on the inner circumferential surface of the cylindrical member, or can be formed on an electric insulation film by covering the metallic patterns with an electric insulation film.

Generally speaking, the cylindrical members in the cylindrical heating elements such as the cylindrical heating elements 1A (FIG. 1), 1B (FIG. 3), 1C (FIG. 6), 1D (FIG. 8, etc.), 1F (FIG. 12(B)), 1F' (FIG. 13), 1D' (FIG. 15), 1J (FIG. 17, etc.) and 1J' (FIG. 21) described above, among others, that is, the cylindrical members such as the cylindrical members 11*a* (FIG. 1, etc.), 172 (FIGS. 7(A), 7(B) and 7(C) to 9, etc.) and 11*j* (FIG. 17, etc.), among others, can be formed of thermosetting resins such as polyimide-based resins and phenol-based resins exhibiting such heat resistance, in order to impart heat resistance for withstanding heat generation of the metallic patterns.

The cylindrical member constituting the cylindrical heating element may be made of a metal. For example, it may use a metallic material comprising nickel, copper or iron as a main ingredient.

However, the cylindrical members 11*a* (FIG. 1, etc.), 172 (FIGS. 7(A), 7(B) and 7(C) to 9, etc.), 11*j* (FIG. 17, etc.) and other cylindrical members in the cylindrical heating elements described with reference to the drawings are made of a polyimide resin.

The thickness of the cylindrical member may be suitably selected depending on whether the cylindrical heating element is used as a component of the rotating member for heating in the form of a roller or as a component of the rotating member for heating in the form of a flexible belt, and depending on the materials of the cylindrical member and other conditions.

The cylindrical members constituting the cylindrical heating element [cylindrical member 11*a* (FIG. 1, etc.), 172 (FIGS. 7(A), 7(B) and 7(C) to 9, etc.), 11*j* (FIG. 17, etc.), among others] may comprise heat conductive particles, e.g., carbon particles and metal particles such as nickel particles dispersed therein, in order to achieve uniform heat distribution.

When the cylindrical member contains heat conductive particles having electric conductivity, for safety, for example, the components which are electrified, such as the metallic patterns and resistive patterns for detecting temperature, may be disposed so as not to come into direct contact with the cylindrical member.

Generally speaking, the metallic patterns which are capable of generating heat by being electrified in each of the cylindrical heating elements such as the cylindrical heating elements 1A (FIG. 1), 1B (FIG. 3), 1C (FIG. 6), 1D (FIG. 8, etc.), 1F (FIG. 12(B)), 1F' (FIG. 13), 1D' (FIG. 15), 1J (FIG. 17, etc.) and 1J' (FIG. 21), among others, that is, the metallic patterns 12*a* (FIG. 1, etc.), 12*b* (FIG. 3), 121*c* to 123*c* (FIG. 6), 12*d* (FIG. 7(A), etc.), 121*d* to 123*d* (FIG. 11), 12*f* (FIG. 12(A), etc.), 12*j*1 to 12*j*3 (FIG. 17), among others, comprise, for example, copper, iron, aluminum or an alloy of two or more metals selected from copper, iron and aluminum, but the metallic patterns in the cylindrical heating elements described with reference to the drawings mainly comprise copper (including those formed of copper).

Formation of the metallic patterns can be formed by etching a copper film formed previously, printing with a conductive paste mainly comprising copper and by other means.

The materials (especially conductivity) of the metallic patterns and the thickness, width and overall length of lines which provide the metallic patterns and are capable of generating heat by being electrified can be selected depending on the target temperature of the heat generated by the metallic patterns. In other words, the conductivity, thickness, width and length of lines which are capable of generating heat by being electrified and provide the metallic patterns can be factors for controlling the temperature of the heat generated, in addition to the power supplied to the metallic patterns, whereby the temperature of the heat generated can be controlled with ease accordingly.

Even when these are taken into consideration, from the perspective of keeping the surface on which the metallic patterns are formed as smooth as possible, the thickness of lines which are capable of generating heat by being electrified and provide the metallic patterns is, for example, in the range from about 12.5 μm to 50 μm.

Examples of the electric insulation film for covering the metallic patterns and, in some cases, the resistive patterns for detecting temperature include, in general, thermosetting resin films having high heat resistance such as polyimide films and varnish films having high heat resistance such as polyimide-based varnishes. A polyimide-based varnish is employed for covering the metallic patterns in the cylindrical heating elements and the like described above.

In any case, the thickness of the electric insulation film is, for example, about 10 μm or more to ensure electric insulation effect. Meanwhile, the thickness of the electric insulation is, in order to prevent it from being uselessly thick, or in order not to hinder the flexibility of the cylindrical heating element when flexibility is required, for example, about 50 μm or less.

As shown in FIGS. 7(A), (B) and (C) as an example, when the cylindrical heating element (e.g., 1D) is formed by forming a metallic pattern (e.g., 12*d*) on the flexible resin sheet (e.g., 171), and rolling this sheet and adhering it onto the inner circumferential surface of the cylindrical member (e.g., 172) with an adhesive or disposing without adhering, or when the cylindrical heating element (e.g., 1F) is formed by, as shown in FIG. 12(A) to FIG. 12(C) as an example, forming the metallic pattern (e.g., 12*f*) on the flexible resin sheet (e.g., 171*f*), and adhering this sheet onto the outer circumferential surface of the cylindrical member (e.g., 11*a*) with an adhesive or disposing thereon without adhering, examples of the flexible resin sheet include, generally speaking, resin sheets comprising a thermosetting resin such as polyimide-based resins exhibiting heat resistance which can withstand heat generation of the metallic patterns. The cylindrical heating elements 1D, 1F described above, among others, employ a polyimide film as the flexible resin sheet for forming the metallic patterns.

The thickness of the flexible resin sheet is, for example, about 12.5 μm or more to ensure strength and electric insulation in order to a certain degree, and is about 50 μm or less in order to maintain flexibility.

The flexible resin sheet 19 (refer to FIGS. 18 and 20) employed to form the resistive patterns for detecting temperature may be also a resin sheet similar to that for forming the metallic patterns.

Examples of the adhesive which can be employed when the resin sheet is adhered onto the circumferential surface of the cylindrical member include heat-resistant adhesives which can withstand the heat generation of the metallic patterns, such as epoxy-based adhesive and polyimide-based adhesive.

In the elastic material layers [211 (FIG. 4), 214 (FIG. 5), 32 (FIGS. 7(B) and (C) to 9), 33 (FIG. 9), 33' (FIG. 10), 35 (FIG. 12(B)), 35' and 37 (FIG. 13), 41 (FIG. 19, FIG. 21), etc.] in the rotating members for heating [21*b* (FIG. 4), 21*c* (FIG. 5), 21*d'* (FIG. 9), 21*e* (FIG. 10), 21*f* (FIG. 12(C)), 21*f'* (FIG. 13), 21*h* (FIG. 15), 21*j* (FIG. 19), 21*j'* (FIG. 21), etc.] of the fixing devices using the cylindrical heating elements, examples of the heat resistant elastic material layer include elastic material layers comprising a silicon resin (e.g., silicone rubber). Among such elastic material layers, the elastic material layers (211 (FIG. 4), etc.) located further on the outer circumferential side than the metallic pattern may contain heat conductive particles, e.g., carbon particles and metal particles such as nickel particles, mixed and dispersed therein, in order to achieve uniform heat distribution.

When the surface of the elastic material layer is covered with a wear-resistant film, [film 212 (FIG. 4), film 34 (FIG. 9, FIG. 15), film 34' (FIG. 10), film 36 (FIG. 12(C)), film 36' (FIG. 13) and film 42 (FIG. 19, FIG. 21), among others], examples of the wear-resistant film include resin films having heat resistance which can withstand the temperature of the rotating member for heating, for example, films and tubes made of fluoride resin such as PTFE and PFA.

With respect to the ring-shaped electrode portions which supply power to the metallic patterns which are capable of generating heat by being electrified in each of the cylindrical heating elements such as the above-mentioned cylindrical heating elements 1A (FIG. 1), 1B (FIG. 3), 1C (FIG. 6), 1D (FIG. 8, etc.), 1F (FIG. 12(B)), 1F' (FIG. 13), 1D' (FIG. 15), 1J (FIG. 17, etc.), 1J' (FIG. 21), and with respect to the ring-shaped electrode portions which detects the variation in resistance from the resistive patterns for detecting temperature in the cylindrical heating elements having such resistive patterns, the ring-shaped electrode portions may be provided integrally with the metallic patterns or resistive patterns, but may be also formed separately from the metallic patterns or resistive patterns and then connected to those patterns by electrical connecting means (material or member) such as silver solder and eyelets. The ring-shaped electrode portions formed separately may also serve as reinforcing members of the end portions of the cylindrical heating element.

In any case, when the ring-shaped electrode portions are connected to the metallic patterns, in order to keep the contact resistance with the power supply electrodes which are brought into contact with the ring-shaped electrode portions low for as long as possible, and when the ring-shaped electrode portions are connected to the resistive patterns, in order to keep the contact resistance with the electrodes for detecting resistance which are in contact with the ring-shaped electrode portions low for as long as possible, the surfaces of the electrode portions are preferably formed of at least one conductive material selected from nickel, gold, rhodium and conductive carbon.

Such a layer part can be obtained by, for example, plating or applying such a material or a paste containing such a material, or by other means.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cylindrical heating element comprising:

a cylindrical member; a metallic pattern provided on at least one of outer and inner circumferential surfaces of the cylindrical member and being capable of generating heat by being electrified; and a resistive pattern for detecting temperature provided on at least one of the outer and inner circumferential surfaces of the cylindrical member.

2. A cylindrical heating element according to claim 1, which is a heating element for constituting at least a part of a rotating member for heating in a fixing device which passes a recording medium on which an unfixed toner image is held through a nip formed by the rotating member for heating and a rotating member for pressurizing which is pressed against the rotating member for heating to fix the toner image on the recording medium with heating under pressure.

3. A cylindrical heating element according to claim 1, wherein the metallic pattern is provided on one of the outer and inner circumferential surfaces of the cylindrical member, and an electric insulation film is formed on the metallic pattern, and the resistive pattern is formed on the electric insulation film.

4. A cylindrical heating element according to claim 1, wherein an elastic material layer is attached on the outer circumferential surface of the cylindrical member.

5. A cylindrical heating element according to claim 4, wherein the elastic material layer is covered with a wear-resistant film.

6. A cylindrical heating element according to claim 1, wherein the metallic pattern is divided into a plurality of patterns for providing a plurality of divided heat generation zones, and the resistive pattern is provided to correspond to each of the divided metallic patterns.

7. A fixing device which passes a recording medium on which an unfixed toner image is held through a nip formed by a rotating member for heating and a rotating member for pressurizing which is pressed against the rotating member for heating to fix the toner image on the recording medium with heating under pressure, wherein the rotating member for heating comprises a cylindrical heating element comprising a cylindrical member, a metallic pattern provided on at least one of outer and inner circumferential surfaces of the cylindrical member and being capable of generating heat by being electrified, and a resistive pattern for detecting temperature provided on at least one of the outer and inner circumferential surfaces of the cylindrical member, and wherein a power supply device for supplying a power to the metallic pattern of the cylindrical heating element of the rotating member for heating and a resistance detecting device for detecting the variation of electric resistance of the resistive pattern based on changes in temperature of the resistive pattern are employed.

8. A fixing device according to claim 7, further comprising a control unit which controls a power fed to the metallic pattern from the power supply device so that the temperature of the rotating member for heating is controlled toward a predetermined target temperature based on a temperature difference between the temperature indicated by an electric resistance of the resistive pattern detected by the resistance detecting device and the predetermined target temperature of the rotating member for heating.

* * * * *